US006601649B2

(12) United States Patent
Beato et al.

(10) Patent No.: US 6,601,649 B2
(45) Date of Patent: Aug. 5, 2003

(54) MULTIPURPOSE UNIT WITH MULTIPURPOSE TOWER AND METHOD FOR TENDERING WITH A SEMISUBMERSIBLE

(75) Inventors: Christopher Louis Beato, Missouri City, TX (US); Joop Roodenburg, Delft (NL)

(73) Assignee: Drillmar, Inc., Houston, TX (US)

( * ) Notice: Subject to any disclaimer, the term of this patent is extended or adjusted under 35 U.S.C. 154(b) by 0 days.

(21) Appl. No.: 10/135,533

(22) Filed: May 1, 2002

(65) Prior Publication Data

US 2002/0166698 A1 Nov. 14, 2002

Related U.S. Application Data

(60) Provisional application No. 60/287,789, filed on May 1, 2001.

(51) Int. Cl.[7] ..... E21B 29/12

(52) U.S. Cl. ..... 166/352; 166/354; 166/355; 405/224; 405/205

(58) Field of Search ..... 166/352, 353, 166/354, 355; 405/195.1, 188, 200, 201, 203, 205, 206, 207, 208, 224, 223.1, 224.4, 224.1; 175/5, 7, 8

(56) References Cited

U.S. PATENT DOCUMENTS

| | | | | | |
|---|---|---|---|---|---|
| 2,931,184 | A | * | 4/1960 | D'Arcangelo | 405/224 |
| 3,378,086 | A | * | 4/1968 | Kivisild | 175/7 |
| 3,552,131 | A | * | 1/1971 | Mott et al. | 405/210 |
| 3,602,302 | A | * | 8/1971 | Kluth | 166/336 |
| 4,065,934 | A | | 1/1978 | Dysarz | 61/87 |
| 4,156,577 | A | | 5/1979 | McMakin | 405/196 |
| 4,161,376 | A | * | 7/1979 | Armstong | 405/196 |
| 4,516,882 | A | * | 5/1985 | Brewer et al. | 405/224 |
| 4,607,982 | A | * | 8/1986 | Brasted et al. | 405/204 |
| 4,666,339 | A | * | 5/1987 | Pollack | 405/202 |
| 4,793,737 | A | * | 12/1988 | Shotbolt | 405/169 |
| 4,797,033 | A | * | 1/1989 | Pollack | 405/202 |
| 4,907,912 | A | * | 3/1990 | Smith | 405/208 |
| 4,983,073 | A | * | 1/1991 | Petty et al. | 405/224 |
| 5,054,963 | A | * | 10/1991 | Williamsson | 405/224 |
| 5,150,987 | A | * | 9/1992 | White et al. | 405/224 |
| 5,154,561 | A | * | 10/1992 | Lee | 414/138.3 |
| 5,297,632 | A | * | 3/1994 | Blandford | 166/344 |
| 5,324,141 | A | * | 6/1994 | Hunter et al. | 405/223.1 |
| 5,379,844 | A | * | 1/1995 | Glasscock et al. | 166/358 |
| 5,421,676 | A | * | 6/1995 | Wybro et al. | 405/223.1 |
| 5,439,321 | A | * | 8/1995 | Hunter | 405/195.1 |
| 5,551,802 | A | * | 9/1996 | Wybro | 405/223.1 |
| 5,704,731 | A | * | 1/1998 | Huang | 405/223.1 |
| 5,791,819 | A | * | 8/1998 | Christiansen | 405/224 |
| 5,964,550 | A | * | 10/1999 | Blandford et al. | 405/224 |
| 6,085,851 | A | * | 7/2000 | Scott et al. | 175/7 |
| 6,139,224 | A | * | 10/2000 | Michel et al. | 405/224 |
| 6,371,697 | B2 | * | 4/2002 | Huang et al. | 405/224.2 |
| 6,431,107 | B1 | * | 8/2002 | Byle | 114/264 |
| 2002/0197116 | A1 | * | 12/2002 | Zou et al. | 405/224.2 |
| 2003/0031517 | A1 | * | 2/2003 | Wetch | 405/205 |

* cited by examiner

*Primary Examiner*—Robert E. Pezzuto
*Assistant Examiner*—Thomas A. Beach
(74) *Attorney, Agent, or Firm*—Wendy K. B. Buskop; Buskop Law Group, P.C.

(57) ABSTRACT

A semisubmersible multipurpose unit (MPU) having a deck, a multipurpose tower secured to the deck, supports, pontoons connected to the supports with each pontoon adapted for ballast transfer, at least two hawsers connected to the MPU for connecting the MPU to an object at sea having a mooring system, a hawser guidance system to direct each hawser to the object at sea, a crane secured to the deck of a semisubmersible MPU, and at least an 6-point mooring system, wherein the combination of the semisubmersible MPU, hawsers and 6-point mooring system create a global equilibrium between the mooring system of an object at sea and the at least 6-point mooring system and the hawsers have both an elasticity sufficient to accommodate the wave frequency between the object at sea and the MPU and a stiffness adequate to synchronize the average and low frequency movements during a 10-year storm.

73 Claims, 16 Drawing Sheets

MULTIPURPOSE UNIT WITH MULTIPURPOSE TOWER AND METHOD FOR TENDERING WITH A SEMISUBMERSIBLE

RELATED APPLICATION

This application claims the benefit of priority of U.S. provisional application Serial No. 60/287,789, filed in the United States Patent & Trademark Office on May 1, 2001.

FIELD OF INVENTION

The present invention relates to a semisubmersible multipurpose unit (MPU) adapted for the drilling and completing of platform-based offshore oil and gas wells and the servicing of offshore oil and natural gas production platforms, subsea wells, and other subsea infrastructure using a multipurpose tower in water depths up to 10,000 feet.

More specifically, the present invention relates to a semisubmersible MPU which can be secured to different types of production platforms, such as a tension leg platform (TLP), a deep draft caisson vessel (SPAR), a fixed platform, a compliant tower, a semisubmersible production vessel or a floating vessel, and which utilizes a unique multipurpose tower. Using the semisubmersible MPU's construction crane, the multipurpose tower can be constructed and removed from the semisubmersible MPU and erected on a production platform as required, in order to enable a tender drilling operation to be conducted. Additionally, when the multipurpose tower is erected on the semisubmersible MPU, the unique semisubmersible MPU with multipurpose tower can be used for drilling operations, well completions, maintenance and work-over operations on subsea wells, as well as the installation, maintenance and removal of other subsea infrastructures, such as manifolds, gathering lines, risers and templates.

BACKGROUND OF THE INVENTION

It is very expensive to provide a production platform with a powerful drilling rig and adequate space for all the drilling equipment needed to drill a well safely and store drilling equipment and materials in an environmentally conscientious manner, particularly where the equipment includes drilling risers, casings, solid waste management equipment, well stimulation, completion assemblies, alloy tubulars, and drilling and completion fluids. Mono-hull and semisubmersible tenders have often been called into service to provide the required space needed on a rig and/or platform during the initial drilling phase of an oil and gas lease. Problems have traditionally existed in that most tenders cannot be kept alongside a platform in a constant spaced relationship during inclement weather without colliding with the platform or risking the safety of the offshore workers. In addition, most tenders can only be used for drilling and completing wells from the production or wellhead platform using a drilling equipment set. Expensive mobile offshore drilling units such as semisubmersibles, jackups and drill ships often have handled exploration, development and well intervention operations in many different weather, water depth, and regulatory scenarios for subsea or mud line suspension wells. This diversity of operating environments has required operators to use many different types of drilling, completion, and work-over rigs. Operators, therefore are required to utilize many short-term contracts, rather than fewer long-term contracts with more versatile rig designs. The requirement to perform work through short-term contracts has impeded performance from operational, safety, and environmental perspectives. It also has impeded the construction of newer, more efficient and environmentally sensible rig designs since drilling contractors have not been able to earn attractive returns on investment due to poor utilization rates and due to the fact that oil and gas companies cannot justify long-term work programs for a rig with a narrow scope of work versatility. Additionally, tenders have not been able to remain in a connected operational capacity during inclement weather without risking the lives of the offshore employees and the damage and potential loss of equipment. The operational windows have been significantly reduced with bad weather and strong loop current conditions, particularly when the environmental load is up to and of a 1-year winter storm or tropical storm event. See U.S. Pat. Nos. 4,065,934, and 4,156,577, which are hereby incorporated by reference, and provide basic information on current tender design. Most tenders must be towed away to a safe location in the case of a tropical storm or extreme weather. This towing adds considerable expense to the drilling contractor and to the customer.

It generally has been believed to be impossible to moor safely a tender alongside a floating production platform in water depths exceeding one thousand feet during harsh weather conditions, such as 10-year storms, and remain operational for long periods of time, such as up to one year, or anytime during hurricane season.

A need has long existed for a semisubmersible MPU that supports platform-based and subsea wells, as well as the related infrastructure. The present invention is designed to provide great versatility with respect to various types of jobs, including for example:

1. shallow and deepwater semisubmersible tender for platform well work;
2. shallow and deepwater semisubmersible tender for platform infrastructure work;
3. shallow and deepwater well work in subsea wells;
4. shallow and deepwater construction support for subsea developments; and
5. shallow and deepwater support for early production operations.

Historically, all of these jobs have been performed by up to seven different types of rigs. This situation has required operators to contract several different types of rigs on short-term contracts. Short-term contracts are those contracts of less than two years, normally less than six months. These short-term work scopes have resulted in highly cyclic rig rates, lower profit margins, and a highly transient offshore work force. The effect has been inconsistent performances and an increased risk of operational problems. The end result is borne by the end user in the form of higher energy costs.

The present invention has been created to provide a semisubmersible MPU with up to 30,000 square feet of additional space, over 8000 barrels of liquid storage capacity, and a self-erecting multipurpose designed tower (MPT) that can be assembled offshore and temporarily secured to either the production platform or the semisubmersible MPU. Further, it has the ability to maintain a constant distance from a production platform while synchronizing to its low and average movement frequencies. This enables the semisubmersible MPU to imitate and act in parallel to the mooring watch pattern of the platform to which it is tied, which has either a figure eight mooring watch pattern or an elliptical mooring watch pattern. The MPU is able to be sustained without damage while moored in an environmental load of wind, current, and wave forces of a 100-year cyclonic storm (such as a hurricane) in the 100-year extreme weather standby position and can also be sustained without damage in a 10-year storm in standby tendering position.

The present invention is related to a semisubmersible tender with conventional derrick equipment set. This MPU with MPT has significant environmental and safety advantages over known semisubmersible tenders and known methods for handling drilling operations and is designed for zero discharge, including the processing and clarification of rainwater and solid wastes such as drill cuttings.

The present invention includes the semisubmersible MPU with multipurpose tower and the semisubmersible MPU with tower mooring system utilizing pre-set anchors, as well as various methods for servicing wells and other subsea operations including, but not limited to, semisubmersible tendering to a deep-water production platform for assisting in the drilling and recovery of oil and gas, in weather that can be up to a 10-year storm and maintaining a standby position in weather up to a 100-year hurricane. The tower can be erected or dismantled using the semisubmersible tender's construction crane, which allows the multipurpose tower to be shared between semisubmersible MPUs and various production platforms, further increasing the versatility and economic advantages.

The present invention is directed to solving one or more of the above problems by providing a semisubmersible MPU and unique multipurpose tower combination for facilitating installation, operational support, drilling, completing and maintaining wells, and/or removal of drilling and completion equipment from a production platform while compensating for platform motions in at least one plane. The present invention also is directed to solving problems associated with drilling and completing wells and performing well maintenance operations on subsea wells located in proximity of or remotely from a production platform, facilitating the installation, operational maintenance, and/or removal of subsea infrastructure such as templates, manifolds or single risers.

SUMMARY OF THE INVENTION

The present invention relates to a semisubmersible MPU with a multipurpose tower (MPT), a crane and a mooring system. The semisubmersible MPU with multipurpose tower has a lightship displacement of less than 20,000 short tons. More specifically, the semisubmersible MPU comprises a deck, a self-erecting multipurpose tower removably secured to the deck, a drawworks for hoisting a drawworks line, a top drive mounted on the tower, hoisting blocks secured to the tower, a control cabin connected to the tower, and a heave compensator. Active heave compensation also can be incorporated into the design using a dynamically controlled drawworks. The MPT comprises at least two members of the group including a base structure, a tower, and a crown. The crane is removably secured to the deck. The hull shape and general configuration of the semisubmersible MPU is designed to result in a combined environmental load of less than 1000 kips in a 100-year extreme weather condition. The semisubmersible MPU further comprises a plurality of pontoons connecting a plurality of the supports connected to the deck, and at least two hawsers for connecting the semisubmersible tender to the production platform. Each hawser has a length, which is selected from the group: the length of the semisubmersible tender, the semisubmersible tendering distance, the length of the production platform, and combinations thereof. The hawsers have sufficient elasticity to accommodate the wave frequency motions between the production platform and the semisubmersible tender, and sufficient stiffness and tension to synchronize the mean and low frequency movement between the production platform and the semisubmersible MPU under an environmental load produced during a storm having a designation of up to a 10-year storm in the semisubmersible tendering position.

This invention also comprises a mooring system that permits the semisubmersible MPU with multipurpose tower to remain connected to the platform, while the hawsers remain slack during a storm designated as at least a 10-year storm for the semisubmersible MPU in the semisubmersible tender standby position. The semisubmersible MPU further has connecting means for securing a first end of each hawser to the semisubmersible MPU, and a hawser guidance system that can be a conical horn to direct each hawser to the production platform or a series of fairleads or sheaves.

The mooring system for the semisubmersible MPU with multipurpose tower combination is an at least 6-point mooring system for the semisubmersible MPU which uses at least 6 anchors and at least 6 mooring lines, each mooring line consisting of: a first length of steel wire rope or chain secured to each of the anchors, a length of polymer rope secured to the first length of steel wire rope or chain, a second length of steel wire rope having a first and second end, wherein the first end is secured to the length of polymer rope and the second end is secured to the semisubmersible MPU.

Each mooring line has sufficient elasticity, stiffness and strength to accommodate load on the semisubmersible MPU under an environmental load produced by up to and by a 10-year storm in the semisubmersible tendering position, and further wherein the mooring lines have a strength to withstand the environmental load produced by up to a 100-year extreme weather condition when the semisubmersible MPU is moved to a 100-year extreme weather condition standby position.

The semisubmersible MPU further has means for creating global equilibrium between the production platform's mooring means and an at least 6-point mooring system of the semisubmersible MPU.

The MPT of the semisubmersible MPU with multipurpose tower is a multipurpose design which is preferably assembled on the water, secured to the semisubmersible MPU deck, and then used for well operations such as well drilling, completion, maintenance, and well work-over and other subsea infrastructure operations or, alternatively, the multipurpose tower is erected as part of the drilling equipment set that is placed on the production platform and then used for well operations such as drilling, completion, maintenance and workover of dry tree wells.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein.

DETAILED DESCRIPTION OF THE PREFERRED EMBODIMENTS

Figure 1:
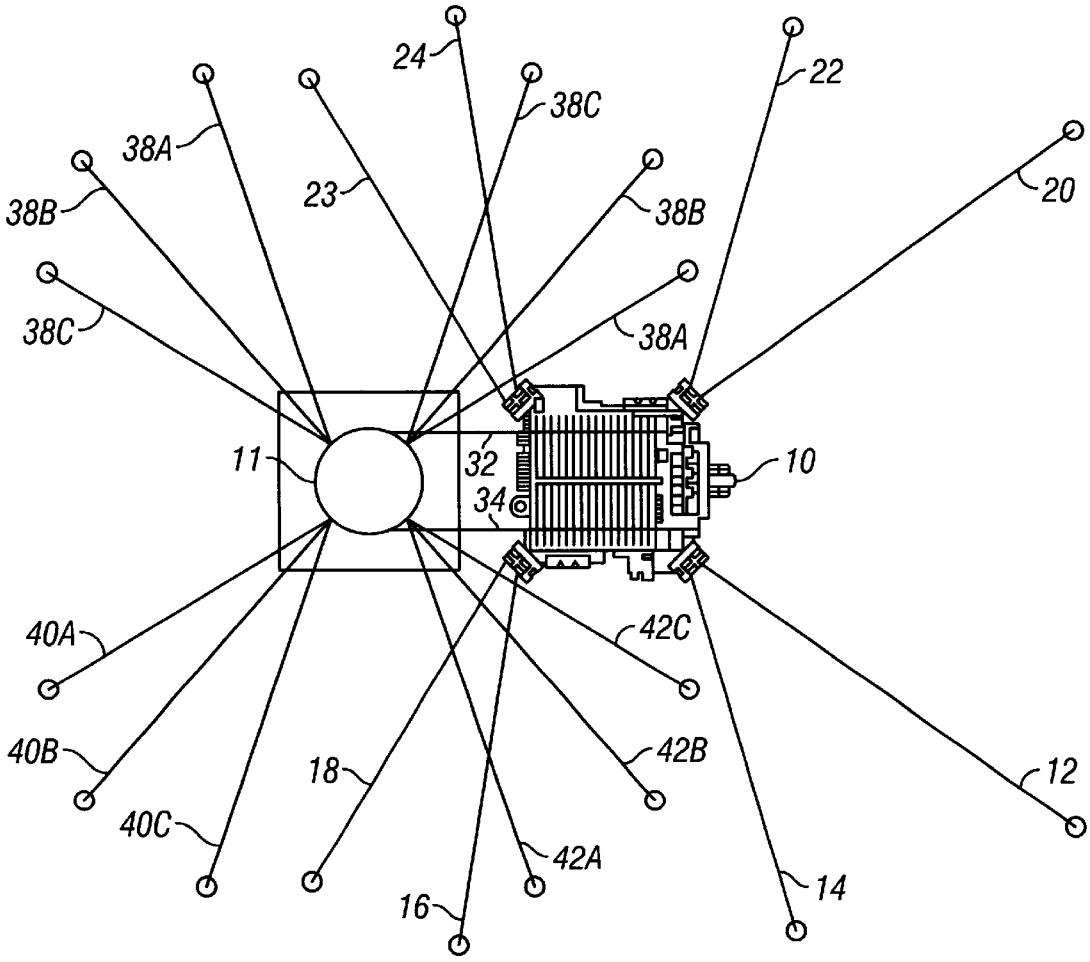
FIG. 1 is a top view of the moored semisubmersible MPU secured to a production platform.

The present invention relates to a semisubmersible MPU with multipurpose tower which can be used with a variety of production platforms, including fixed production platforms and floating production platforms. Suitable platforms include, for example, deep draft caisson vessels (SPARs), tension leg platforms (TLPs), compliant towers, semisubmersible production vessels and other floating ships or vessels. The present invention also relates to a semisubmersible MPU with tower and mooring system, which can be attached to a production platform and successfully eliminates the risk of collision between the semisubmersible MPU and the production platform during weather conditions designated as up to a 10-year winter storm, thereby significantly improving the health, safety and operating environment on an oil and natural gas production platform and drilling rig while also enabling drilling and production operations to proceed, to some extent, during such a weather condition.

The semisubmersible MPU of the present invention has significant health, safety and environmental advantages over other conventional drilling rigs. More specifically, when compared to a platform rig and jack-up rig, the advantages of the present invention include:

1. the MPU offers over 10 times the working deck space than either a platform rig or a jack-up unit, virtually eliminating confined space logistical operations;
2. the operation of the semisubmersible MPU requires only ⅕ to ⅓ of the equipment to be placed on the production platform compared to an API platform rig;
3. the invention is helpful because it does not require any engines or exhaust systems to be placed on the production platform, thereby reducing the fire risk and blow-out risk associated with oil and gas well operations;
4. the multipurpose design, combined with the use of a construction crane mounted on the semisubmersible MPU, enables efficient and safe mobilization and support operations, significantly reducing the number of lifts required to initiate, drill and complete operations on the platform, thereby essentially eliminating over 75% of the lifts typically required to erect or remove a typical API platform rig onto or from a production platform;
5. ninety percent (90%) fewer people are required to be housed and work on the production platform itself, when the invention is used, thereby removing personnel from harm's way in case of an oil and gas production emergency;
6. the unique invention's storage capacities enable much more efficient logistical planning and virtually eliminate nighttime logistical offloading or back loading, which has historically been the time when a significant percent of accidents and spills typically occur;
7. the invention's mooring system (i) enables a predictable operational weather window, matching or exceeding that of either a platform rig or a jack up rig, (ii) virtually eliminates the risk of collision damage to the production platform as well as pipelines during all operational events, (iii) enables the unit to quickly evacuate the immediate platform area in case of an emergency, and (iv) enables the unit to facilitate immediately the rescue or support of any required emergency response plans;
8. the semisubmersible tender provides zero discharge of drilling and completion fluids, drill cuttings, spilled or uncontained leaks, and unprocessed water, including rainwater; and
9. the invention's unique tubular handling capabilities remove at least fifty percent (50%) of the drill floor activities off the confined space of the drill floor and onto the main deck of the semisubmersible as well as automating these activities.

The present invention also relates to a mooring system for securing a semisubmersible MPU with multipurpose tower to a production platform, comprising a semisubmersible tender for a production platform having mooring means and having a lightship displacement of less than 20,000 short tons. Preferably, the semisubmersible MPU with multipurpose tower has a lightship displacement in the range of 8000 to 15,000 short tons, and more preferably about 12,000 short tons.

This novel semisubmersible tender, which hereinafter is referred to the multipurpose unit or MPU, comprises a deck, a construction crane removably secured to the deck and a multipurpose tower removably secured to the deck. The multipurpose tower (hereinafter sometimes referred to as the MPT) comprises at least two of the following three members: a base structure, a central tower, and a crown. These members can be connected or assembled and hydraulically pinned together. The MPT also is capable of being easily dismantled and removed from the semisubmersible MPU using the construction crane. The construction crane, which can be secured to the MPU deck, is an important element of this system, otherwise the tower cannot be assembled at sea. The crane preferably is a pedestal construction style crane capable of lifting at least 250 short tons. The crane can be a skiddable crane and also can be a modular crane. The central tower (hereinafter sometimes referred to as the tower) further comprises a drawworks line, drawworks for hoisting the drawworks line, a top drive mounted on the tower, blocks secured to the tower, a control cabin connected to the base structure and a heave compensator.

The semisubmersible MPU has a configuration that results in a combined environmental load of less than 1000 kips in a 100-year extreme weather condition. This configuration includes a plurality of supports with a rounded shape connected to the deck, a plurality of pontoons connecting the supports, each pontoon being capable of transverse ballast transfer and longitudinal ballast transfer, at least two hawsers for connecting the semisubmersible MPU to the production platform and connecting means mounted on the semisubmersible MPU and securing a first end of each hawser and a hawser guidance system for each hawser to direct each of the hawsers to the production platform. Each hawser has a length which is selected from the group: the length of the semisubmersible MPU, the semisubmersible tendering distance, the length of the production platform, and combinations thereof. Each hawser has sufficient elasticity to accommodate the wave frequency between the production platform and the semisubmersible MPU, and sufficient stiffness and tension to synchronize the mean and low frequency movement between the production platform and the semisubmersible MPU under an environmental load produced during a storm having a designation of up to a 10-year storm in the semisubmersible tendering position. The hawsers remain slack during a storm designated as at least a 10-year storm for the semisubmersible MPU in the semisubmersible MPU standby position.

The semisubmersible tender uses an at least 6-point mooring system comprising at least 6 anchors and at least 6 mooring lines, each line consisting of: a first length of steel wire rope or chain secured to each of the anchors, a length of rope secured to each of the first length of steel wire rope or chain, a second length of steel wire rope or chain having a first and second end, wherein the first end is secured to the length of rope and the second end is secured to the semisubmersible MPU, and wherein each mooring line has sufficient elasticity, stiffness and strength to accommodate load on the semisubmersible MPU under an environmental load produced up to and by a 10-year storm in the semisubmersible tendering position, and further wherein the mooring lines have a strength sufficient to withstand the environmental load produced by up to a 100-year extreme weather condition when the semisubmersible MPU is moved to a 100-year extreme weather condition standby position. It should be noted that it is preferred that the mooring lines conform to API standard RP-2SK. In addition, each of the at least 6 mooring lines can be tensioned when in use.

The semisubmersible MPU of the present invention also comprises means for creating global equilibrium between a production platform's mooring means and the at least 6-point mooring system of the semisubmersible MPU.

The 10-year winter storm and 100-year hurricane storm designations are industry specific terms used to describe particular storms with given wind speed, wave height, peak spectral period, and current velocity. A 10-year winter storm is a storm with wind speed of 48 knots, wave height of 16 feet, peak spectral period of 10.5 seconds, and a water current velocity of 1.6 knots per second. The 100-year hurricane storm is a storm with wind speed of 95 knots, wave height of 40 feet, peak spectral period of 14 seconds, and a water current velocity of 3.0 knots per second.

The present invention is designed to allow operators to enter into long-term contracts with semisubmersible MPU owners, which allows the unit to be provided at lower rates, thereby lowering overall costs while increasing operational efficiency and minimizing production down time. The present multipurpose tower and semisubmersible MPU invention permits significantly reduced risk and expense of production downtime in a deepwater field since a single semisubmersible MPU can handle both platform and subsea based operations very efficiently with a 1–3 day operational transition time between operations. Additionally, this invention facilitates the installation and repair of platforms, as well as the repair of infrastructure by using the multipurpose tower and crane, which again provides a vessel which reduces production downtime. This particular vessel is novel because of the combination of semisubmersible MPU configuration, semisubmersible MPU capacity and deck space, semisubmersible tender mooring system and the multipurpose tower feature.

The present invention also minimizes deepwater field development capex since floating production platforms and subsea well templates and infrastructure can be located in close proximity of one another, not up to 8 miles apart, as in conventional situations. The multipurpose tower enables well templates to be safely installed and serviced even during hurricane season. In addition, production platforms no longer need to be large enough to accommodate an API platform rig. Further, the invention permits the minimization of production flow assurance problems, and the associated production downtime, since floating production platforms and subsea well infrastructure and subsea templates can be located in close proximity and safely serviced even during the hurricane season.

The multipurpose tower and semisubmersible MPU is a combination wherein the MPT can be readily erected or dismantled using the semisubmersible MPU construction crane, thereby enabling the multipurpose tower to be shared between the semisubmersible MPU and other production platforms, thereby further increasing the economic efficiency of the unit.

The MPU of the present invention preferably has a size with at least about 15,000 square feet and up to about 40,000 square feet of deck space. More preferably, the MPU has a size of about 25,000 square feet and a deck that has at least about 20,000 square feet of usable deck space. The MPT is constructed so that it can be moved and positioned over a moon pool, which is at least 20 feet by 20 feet. The MPT preferably has a skid base that allows the multipurpose tower to be positioned beside or over the moon pool or cantilevered over the side of the semisubmersible MPU.

The semisubmersible MPU has a rig floor, which can be skidded, lifted and/or mounted and pinned on the skid base when needed. A rotary table can be used, which can be inserted, integrated and/or mounted onto the rig floor. Completion and well intervention high pressure riser systems can be run and tensioned from equipment positioned and supported from either the moon pool support structure within the semisubmersible MPU or the tower skid base itself. The semisubmersible MPU with multipurpose tower can be used for subsea drilling, completion and well intervention blowout preventers that can be installed on the top of horizontal trees or subsea wellheads. This unique invention can be used for a high-pressure riser surface BOP system for well intervention procedures on live wells.

The invention can be modified to include portable subsea surface BOP test stump and tree bases and carriers, which can be installed on the main deck of the semisubmersible MPU. These bases and carriers can be skid mounted so that they can be retraced from under and/or beside the multipurpose tower to facilitate the handling of the subsea BOPs and trees during well operations and the initial installation, recovery of trees and repair operations. Ideally, these BOP's and trees can be lowered into the moon pool in one piece through the main deck of the semisubmersible MPU to facilitate operations.

Finally, a riser handling system can be installed on the semisubmersible MPU with multipurpose tower. This riser handling system can facilitate the running and retrieving of the riser systems and provide efficient storage on the deck and/or in the columns of the semisubmersible MPU.

Referring now to FIG. 1, the semisubmersible MPU (10) is shown moored with at least 8 mooring lines, (12), (14), (16), (18), (20), (22), (23), and (24). It is contemplated that the mooring system of the invention can be installed by first placing anchors in the sea floor, then attaching mooring lines to the anchors, placing a buoy on the line secured to the anchors, and then attaching the mooring line to the semisubmersible MPU. A particular embodiment for a semisubmersible MPU mooring system in relation to a SPAR's mooring system is shown in FIG. 1. It is envisioned that this type of mooring system can be preset prior to the arrival of the semisubmersible MPU.

For a SPAR (11), the semisubmersible tender (10) is secured to the SPAR (11) using at least two hawsers (32) and (34). This SPAR also is known as a deep draft caisson vessel. It should be noted that a SPAR is typically moored with 12 to 16 mooring lines in four cluster groups. FIG. 1 shows the SPAR's mooring lines as shown as **(36*a*), (36*b*), (36*c*), (38*a*), (38*b*), and (38*c*), (40*a*), (40*b*), and (40*c*) and (42*a*), (42*b*) and (42*c*)**. The present invention enables a SPAR to be used as a drilling and production platform without significantly increasing its size or cost yet maintaining a high safety factor for the production crew on board the SPAR.

Figure 2:
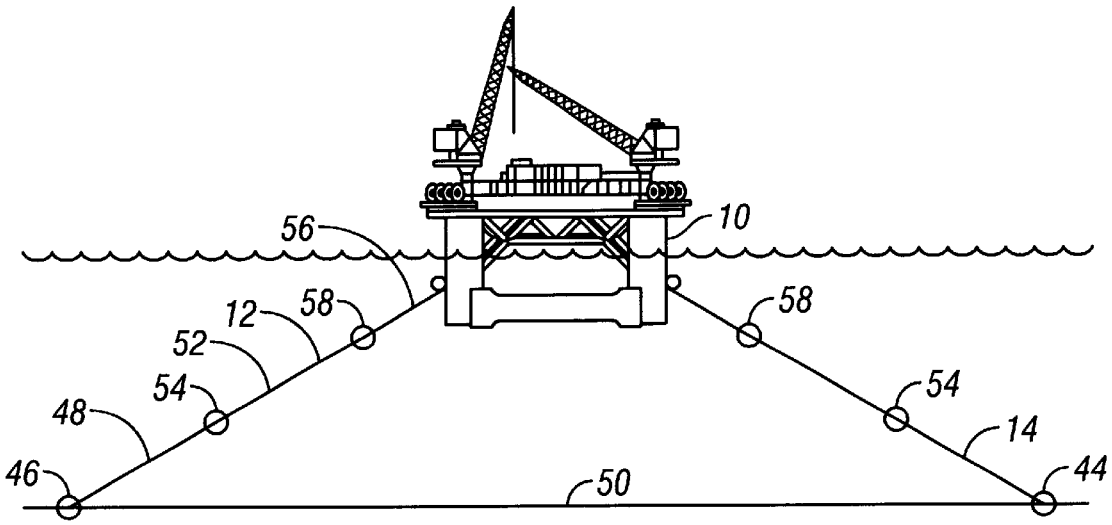
FIG. 2 is an end view of the mooring line orientations on a rig for a moored semisubmersible MPU.

FIG. 2 shows one example of the invention, where the semisubmersible MPU (10) is moored to sea floor (50) in 6000 ft of water. Two mooring lines (12) and (14) of the at least 8 mooring lines are shown secured to the sea floor 50 in FIG. 2. A vertically loaded anchor (44), such as a plate anchor as described in U.S. Pat. No. 6,122,847 and hereby incorporated by reference, is used to moor the semisubmersible MPU to the sea floor. Alternatively, a piled anchor which is suction installed can be used as the mooring anchor for the semisubmersible MPU. The anchor (44) is on one end of the mooring line (14). A second anchor (46) is shown on one end of mooring line (12). On the other end of the mooring line is secured a first length of steel rope (48), which is termed "anchor wire rope."

In 6000 feet of water, the semisubmersible MPU (10) is moored to a SPAR, and the length of the anchor wire rope (48) for the SPAR is typically 1500 feet using a rope with a preferred outer diameter of 4½ inches. The breaking strength of rope (48) is at least 2061 kips. Rope (48) is connected to a polymer rope (52), which is most preferably a polyester rope made by Marlow, UK, or Whitehill Manufacturing Corporation, U.S.A., or CSL (Cordvaia) of Saul Leopoldo, Brazil. The length of the polymer rope (52) for 6000-feet of water is preferably 5500 feet with a preferred outer diameter (OD) of 7.1 inches. The outer diameter of this rope can vary between 4 inches and 10 inches and still remain suitable for use in this invention. The breaking strength of the polymer rope (52) should be at least 2300 kips. A buoy (54), preferably having a net buoyancy of at least 40 kips and up to 100 kips, is secured to the polymer rope (52) to keep the mooring line (12) off the sea floor (50).

In an embodiment where the water is 1760 feet, it is contemplated that the mooring system can use pre-installed segments, which include suction installed pile anchors or high performance drag embedment anchors. For 1760 feet of water, the anchor wire rope (48) is preferably 500 to 550 feet long with an outer diameter of about 4 and ⅞ inches and a six-strand construction. Connected to the anchor wire rope (48) of this water depth embodiment is rope (56), which preferably is about 3100 feet long and has a 7½-inch OD, with a parallel strand construction. A second spring buoy (58), having 40-kip net buoyancy is secured to the rope (56).

The polymer rope (52) preferably is made of polyester. It is connected at the end opposite to a second steel rope, known as a "vessel wire rope." For a 1760-foot water depth embodiment, this vessel wire rope is approximately 3000 feet long having an outer diameter of 4 and ⅞ inches. The breaking strength of vessel wire rope is at least 2300 kips with a 1¹⁄₁₆ inch corrosion allowance. A preferred vessel wire rope can be obtained from Diamond Blue. Vessel wire rope is secured at the other end to semisubmersible MPU (10). A high strength six-strand construction is preferred for vessel wire rope. Other suitable polymer ropes (52), contemplated for use in the present invention, include, but are not limited to, polypropylene rope, polyethylene rope, polybutylene rope and combinations thereof. The construction of polymer rope (52) can range from parallel strand construction to wound multiple strand constructions as is generally known in the maritime industry.

Although the mooring system shown in FIG. 1 is an 8-point mooring system, it is to be understood that when the MPU of the present invention is in the tendering position, an at least 6-point mooring system can be used. Thus, the semisubmersible MPU can be moored with at least 6 mooring lines when it is in the tendering position and can be moored with at least 8 mooring lines when it is not in the tendering position but being used as a support vehicle, such as a module operating drilling unit (MODU). In certain benign weather environments, such as the south asian seas, a 6-point mooring system can be utilized with one of the mooring lines broken or otherwise damaged. Similarly, although an at least 8-point mooring system is preferred in the non-tendering position, 8 mooring lines with one damaged or broken, still can be used. When 9 or more mooring lines are used on the semisubmersible MPU, instead of 8 mooring lines, the thickness of the mooring lines can be reduced, while still maintaining the required design safety factors for the semisubmersible MPU.

Figure 3:
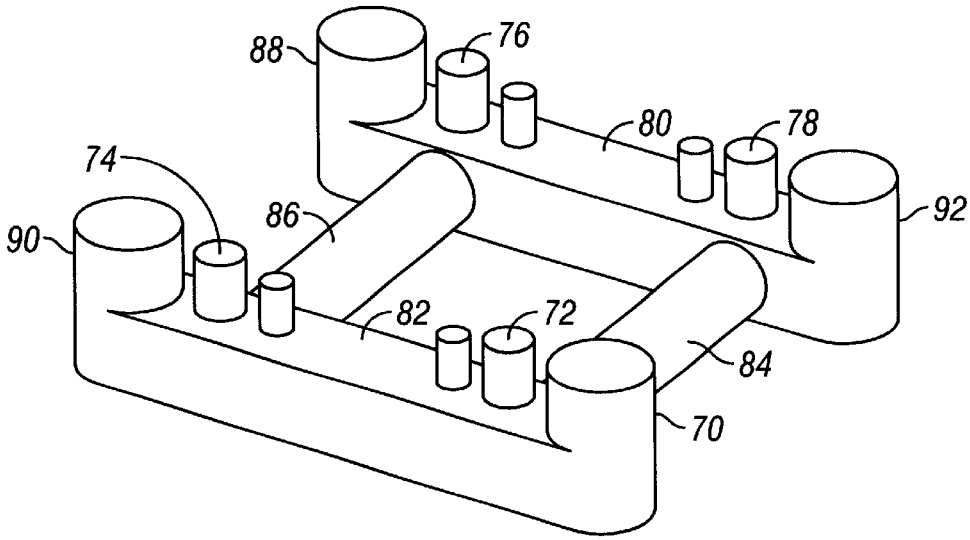
FIG. 3 is a perspective view of one embodiment of the semisubmersible MPU's ring pontoon configuration.

FIG. 3 shows a perspective view of the semisubmersible MPU (10) having a plurality of supports (70), (72), (74), (76), (78), (88), (90), and (92) and a plurality of pontoons (82) and (84) connected to the plurality of supports. In the most preferred embodiment, the supports are structures with rounded edges or round shapes, such as columns. A deck is attached to these columns. In this Figure, the semisubmersible MPU is shown having a rectangular configuration. The semisubmersible MPU preferably is constructed with between 2 and up to 4 pontoons and with between 3 and up to 12 supports or columns. Preferably, the semisubmersible tender preferably is constructed in a ring design or configuration, having between 3 to 12 column supports. In one of the most preferred embodiments, the semisubmersible tender is constructed in a triangular ring configuration with 3 pontoons and columns. However, it is to be understood that other configurations, such as a circular ring design, square semisubmersible MPU design, and rectangular shaped design are contemplated to be within the scope of the present invention. FIG. 3 shows four large rounded supports as (70), (88), (90) and (92) and four smaller rounded supports (72), (74), (76) and (78). At least two pontoons (80) and (82) are shown in this embodiment. Each pontoon is capable of being ballasted. Preferably, each pontoon, if used, has rounded edges. In one embodiment, each pontoon is designed to have a stem and bow. Secured to the pontoons in one usable embodiment are at least two buoyant transverse cross members (84) and (86), which are generally kept void but are capable of being quickly ballasted. The pontoons are capable of transferring ballast quickly between pontoons and columns. The contemplated quick transverse ballast transfer is between about 30 and 300 gallons per minute, and preferably, 80 to 300 gallons per minute, and the quick longitudinal ballast transfer is between about 180 and 300 gallons per minute.

Figure 4:
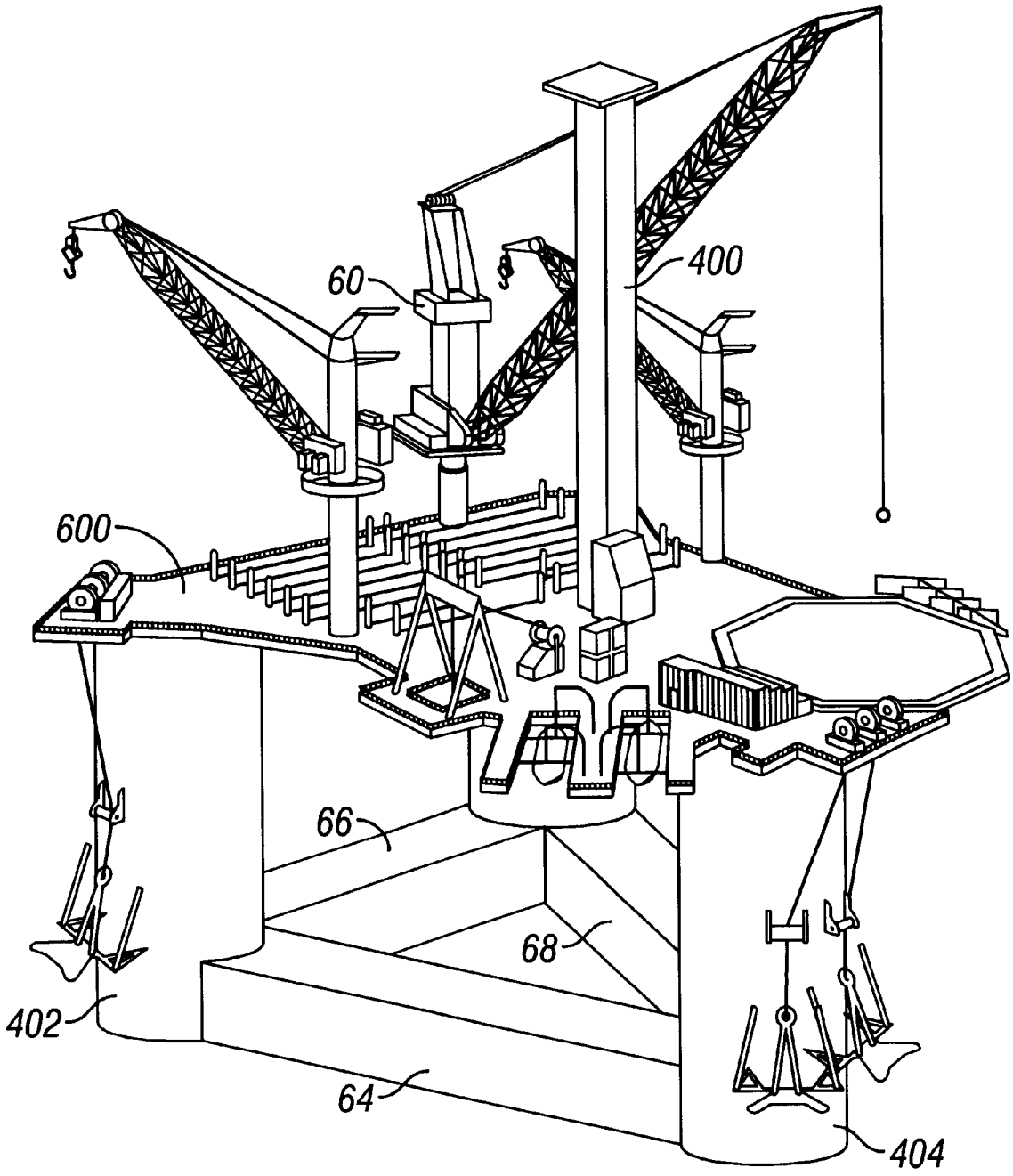
FIG. 4 is a perspective view of a triangular ring pontoon design embodiment of the semisubmersible MPU of the invention with a tower attached; in order to conduct well work on subsea wells.

FIG. 4 shows an alternative construction using cross members (64), (66) and (68) with the pontoons connected in a triangular shape or configuration. Supports or columns 402 and 404 are disposed on the pontoons. In one embodiment, at least one of these columns comprises a portion of the periphery of the deck of the semisubmersible MPU. Crane (60) and tower (400) each are removably secured on deck (600).

It should be noted that it is within the scope of the present invention that the semisubmersible MPU can be self-propelled or towed on a body of water to a position near a production platform.

The semisubmersible MPU is constructed to have a size and configuration which results in a combined environmental load of less than 1000 kips during a 100-year extreme weather condition, such as a hurricane, when one of the at least 8 mooring lines is damaged and when the semisubmersible MPU is in the standby position. The semisubmersible MPU configuration results in a combined environmental load of less than 600 kips during a 10-year storm when secured to a production platform, like a SPAR, with one mooring line damaged, in a semisubmersible tendering position, with 40 to 80 feet of consistent clearance between the semisubmersible MPU and the production platform. The semisubmersible MPU in FIG. 4 can be a semisubmersible tender for drilling for work-overs and well invention and placement or maintenance of subsea infrastructure.

In a preferred embodiment, it is contemplated that the supports can contain traditional and non-traditional items. In one embodiment it is contemplated that when certain non-traditional items are used, they can be used to lower the center of gravity of the semisubmersible MPU for additional stability. These items can include, for example, filled tanks of sterile brine completion fluids and ballast transfer equipment, bulk storage tanks, drilling and storage tanks, fluid tanks, ballast control systems, mooring line storage reels, transfer equipment for fluids in the designated tanks and combinations thereof. Specifically, when mooring storage line reels are used, they can be connected to winches within the supports, thereby lowering the center of gravity of the semisubmersible MPU. The mooring winch storage also can be disposed in the supports to lower the center of gravity of the semisubmersible MPU. The semisubmersible MPU supports, when used as bulk storage tanks, can contain barite, cement, or bentonite. Another use for the columns is to contain sterile completion fluids or base drilling fluids. The tanks can hold completion fluids such as calcium chloride, zinc bromide or potassium chloride.

The semisubmersible MPU and mooring system of the present invention is capable of maintaining a safe clearance between the platform and the semisubmersible MPU under the maximum operating conditions, specifically, up to the 10-year winter storm and up to the 10-year loop current condition in the Gulf of Mexico. For a SPAR, this clearance is achieved by the use of dual mooring hawsers, each of which are tensioned to 100-kips to 150-kips by adjusting the line tensions of the SPAR and the semisubmersible MPU spread mooring legs while keeping the vessels at their designated locations. The designated location for the SPAR is directly above the subsea wellheads with the semisubmersible MPU generally being maintained between 40 feet and 80 feet from the SPAR.

Safe distance is maintained between the platform and the semisubmersible MPU at all times, thus eliminating vessel collision risk. The use of tensioned hawsers assures synchronized mean and low frequency movement between the two vessels. In this manner, should any mooring line break, the two floating vessels would move apart, thus increasing the average distance between the two units. When a major storm approaches or when peak hawser loads repeatedly exceed the safe working limit of 700 kips, the hawsers will be slackened. The semisubmersible MPU with tower then will be pulled away from the production platform to a safer distance and position, referred to as a semisubmersible tender standby position, due to the greater tension in the semisubmersible MPU bow mooring lines. If required, the semisubmersible MPU can be winched further away from the production platform using its at least 6-point mooring system. In addition, should the safe working load (700 kips) of the hawsers be exceeded due to peak loads caused by rough waves, for example, the brakes on the hawser winches will be allowed to drag, thereby ensuring that the hawser will not break, but also will not allow so much hawser to pay out that the telescoping personnel bridge will need to be disconnected.

The semisubmersible MPU also can be winched away further from the platform to an extreme weather event standby position in the event of an imminent tropical storm or hurricane. The semisubmersible MPU mooring is designed to withstand the 100-year hurricane weather condition and yet maintain a safe clearance with the production platform under a scenario where all mooring lines are intact or if one mooring line is damaged.

As shown in FIG. 4, the multipurpose tower (60) can be mounted on a deck (600). This embodiment of a triangular-shaped semisubmersible preferably has three supports (402), (404) and (405), support (405) being hidden in the Figure. Crane (60), secured to deck (600), is critical in order to raise and assemble the tower (400).

Figure 5:
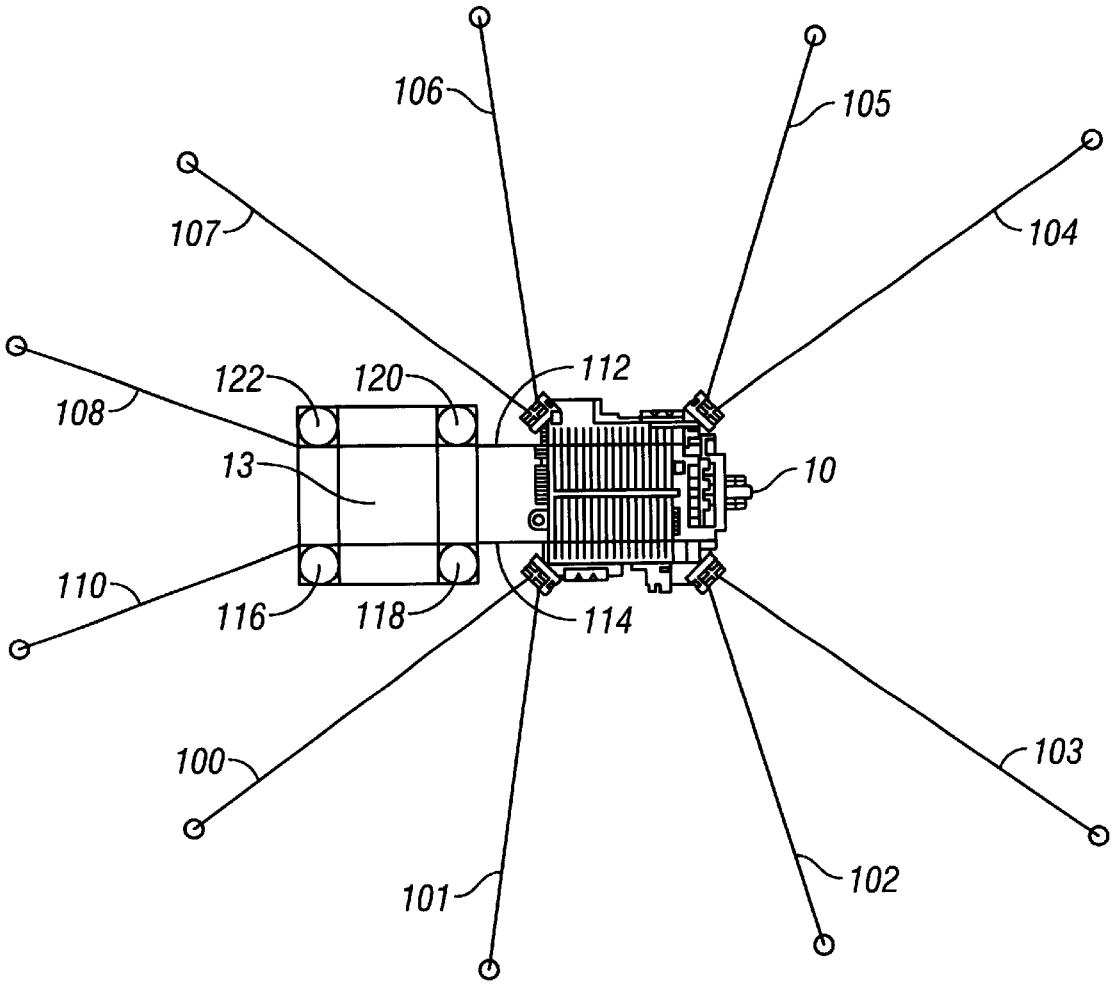
FIG. 5 is a top view of a semisubmersible MPU moored to a tension leg platform.

FIG. 5 shows a preferred mooring line orientation for the semisubmersible MPU when secured to a tension leg platform (13), hereinafter sometimes referred to as TLP. Mooring line (100) is oriented about 45 degrees from mooring line (102) when in the hurricane standby position. The FIG. 5 shows the semisubmersible MPU mooring lines (100), (101), (102), (103), (104), (105), (106) and (107). The TLP's auxiliary mooring lines or tensioning lines are (108) and (110). These tension lines are used as a means to create global equilibrium between the TLP and the semisubmersible MPU. The hawsers (112) and (114) connect the platform and semisubmersible MPU, and support columns for the TLP are identified as (116), (118), (120) and (122). The TLP's position will be maintained by the use of its auxiliary mooring lines (108) and (110) which are attached to the TLP on far side of the semisubmersible MPU and opposite MPU mooring legs (103) and (104).

The present invention additionally has zero discharge, which is a significant improvement over most current drilling tenders, mobile offshore drilling units and API platform rigs, in order to protect the environment.

Figure 6:
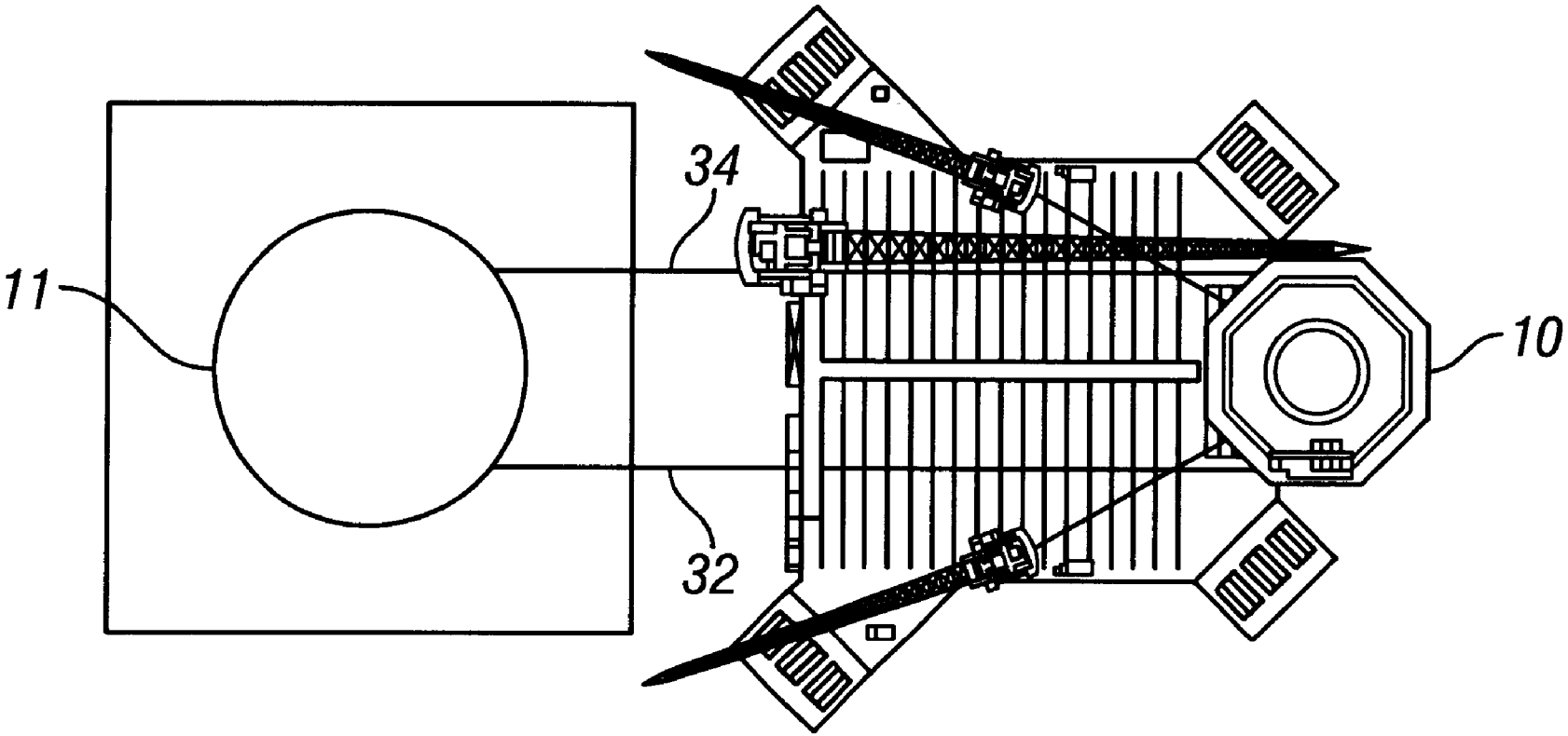
FIG. 6 shows a top view of a semisubmersible MPU secured to a SPAR with the hawsers.

In FIG. 6, semisubmersible MPU (10) connects to a production platform (11) using at least two hawsers (32) and (34), each hawser being constructed from a polyamide, such as nylon. Each hawser (sometimes referred to as hawser line) preferably has a diameter of 5.5 inches. The diameter of the hawser can range from 3 to 7 inches and the length can vary depending on the type of production platform the semisubmersible MPUs are tied to as well as the anticipated severe weather conditions; each hawser having a length which is selected from the group: the length of the semisubmersible MPU, the semisubmersible tendering distance, the length of the semisubmersible production vessel, and combinations thereof. The hawser is preferably rated for up to 1000 kips breaking strength.

Each hawser is connected to a connecting means such as a hawser winch, which is capable of variable payout for connecting the semisubmersible tender to a production platform, such as a tension leg platform. Alternatively, the connecting means are a hawser wire rope that winds on a hawser winch. A preferred nylon hawser is composed from fibers made by the E. I. DuPont Company of Wilmington, Del. Each hawser line should have sufficient elasticity to accommodate the different wave frequency movement between semisubmersible MPU and production platform, but are stiff enough so that semisubmersible MPU and production platform mean and low frequency movements can be synchronized, thereby enabling the semisubmersible MPU to move in substantially identical mooring watch pattern shapes, such as a figure eight mooring watch pattern or an elliptically shaped mooring watch pattern.

In a preferred embodiment, each hawser has sufficient elasticity to accommodate the wave frequency movements between the production platform and the semisubmersible MPU, and sufficient stiffness to synchronize the mean and low frequency movement between the production platform and the semisubmersible MPU under an environmental load produced during a storm having a designation of up to a 10-year storm in the semisubmersible tendering position, and wherein the hawsers remain slack during a storm designated as at least a 10-year storm for the semisubmersible MPU in the semisubmersible tender standby position. The semisubmersible MPU can synchronize between the mean and low frequency excursions, which have greater than 50-second periods, by tensioning the hawsers. The inventive system allows the semisubmersible MPU to cope with the relative wave frequency motions that can range from 3 to 25 seconds in full cycle period by optimizing the elasticity of the mooring lines.

A usable safe operating distance is considered between 35 and 80 feet, and preferably at least 40 and more typically, 50 to 70 feet of safe clearance in normal weather and current which can include a sudden squall, a one-year winter storm and a one-year loop current.

The semisubmersible tender has three positions relative to the production platform:

1. extreme weather standby (for cyclone storms);
2. semisubmersible tender standby for weather conditions of 10-year storms, or greater; and
3. operating semisubmersible tender for weather conditions up to a 10-year storm.

In addition, it is contemplated that there may be a benign weather condition position as well, which could be closer than 35 feet.

In the extreme weather standby mode, the hawsers are slacked, then the hawsers are released and the semisubmersible MPU is winched away to a safe distance so that no collision occurs between the production platform and the semisubmersible MPU. This extreme weather standby mode is used in not only the 100-year winter storm, but in a 100-year hurricane or when a 100-year loop current causes severe current, wave, and related weather conditions. The safe clearance distance maintained by the semisubmersible MPU in the extreme weather semisubmersible MPU standby mode is preferably at least 200 feet for the 100-year winter storm, and at least 500 feet for the 100-year hurricane and up to 1000 feet when moored in extremely deep water.

For the semisubmersible MPU standby mode, such as in weather which is greater than a 10-year storm, the semisubmersible MPU still is connected to the platform with the hawsers slack, but the semisubmersible MPU is maintained at a distance of between about 150 and 350 feet. In the operating semisubmersible tender mode, the clearance between the semisubmersible tender and the platform is maintained a relatively constant 50 to 70 feet.

Figure 7A:
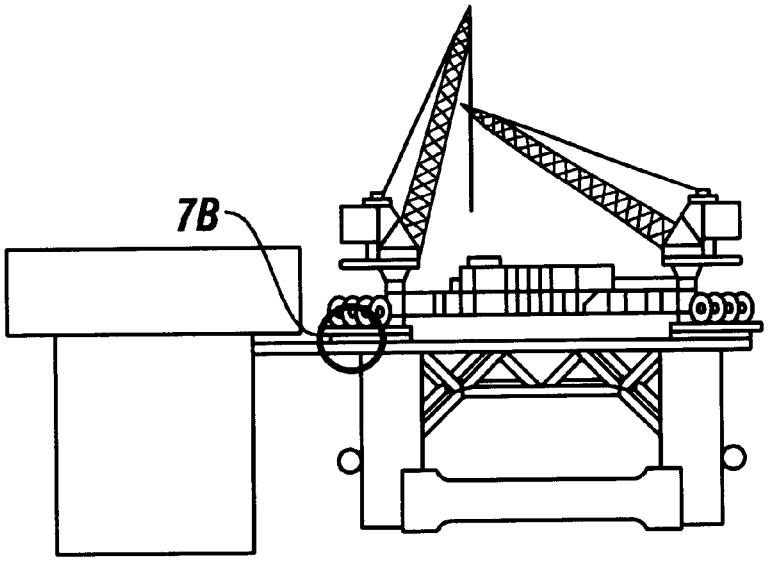
FIG. 7 shows a top view of an embodiment of the hawser guides.
Figure 7B:
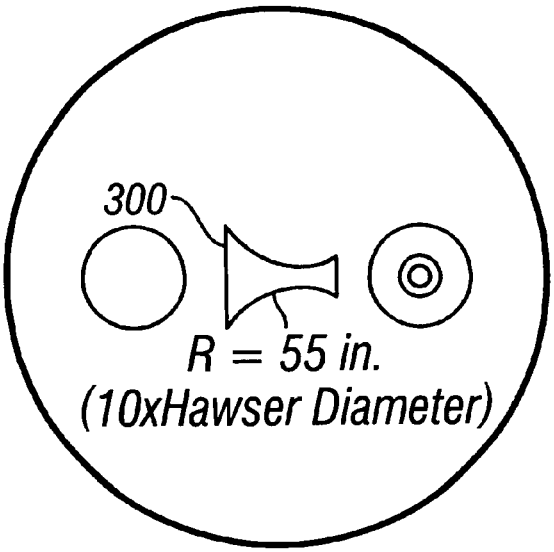

FIG. 7 shows that the hawser can be passed from the semisubmersible MPU through a hawser guide or horn (300), which is in the shape of a conical horn. The horn (300) reduces friction on the hawsers, thereby enabling successful slackening with minimal friction impact on the lines. These conical horns are of a bullhorn style, with the largest portion of the horn facing the stern of the semisubmersible MPU and production platform, and the narrow portion facing the bow. The radius of curvature of the horn should be at least 8 to 14 times the diameter of the hawser to ensure that the hawser is not damaged during use. Preferably, the diameter is 10 times the diameter of the hawser. The horns are preferably of steel with a treated interior surface to minimize the coefficient of friction between the guide itself and the hawsers to minimize the frictional wear or damage of the hawsers. The hawser passes through the center of the horn (300).

The semisubmersible tender has an additional hawser guidance element for the hawser lines. Rounded pad eyes are secured to the underside of the hull and the hawsers pass through the pad eyes to a wire, which is connected to a wire winch on the bow of the semisubmersible tender. The purpose of these pad eyes are to support the hawser when slack, thus preventing the hawsers from being damaged. The purpose of the wire and wire winch is to eliminate the need for the hawser to be wound on a winch drum and passing though sheaves, which would damage the hawser. When the semisubmersible tender moves to the semisubmersible tender standby position, the wire is simply paid off of the wire hawser winch. The other end of hawser is connected to the production platform using a pad eye and U-bold shackle arrangement or some other similar kind of attachment device. Alternatively, a special design hawser with a protective outer sheath or covering can be used so it can be spooled onto a winch drum and through fairleads and sheaves and will not be crushed or damaged. Such a hawser currently is produced and sold by Whitehill Manufacturing.

The hawser winches for the semisubmersible MPU are preferably ones with drums having a capacity of at least 600 feet of 3-inch wire rope. The winches preferably have a pull rating of 100,000 lbs @ 28 fpm. The drums preferably have brakes, which are springs set and air release band types rated at 600,000 lbs. The winch power preferably is 100 hp using an AC motor with disk brakes and variable frequency drive. The drum preferably has a 45-inch root diameter with 60-inch long size for single layer operation. In the preferred embodiment, the winch rope is connected to the hawser, and then the winch motor exerts the desired pre-tension. At this point the winch drum brakes are set. If the hawser line pull exceeds the brake rating (600,000 lbs), rope will pull off the drum until equilibrium is reestablished. Any readjustment to the length/tension will be accomplished manually. Alternatively, a winch capable of spooling at least 600 feet of 5.5" nylon hawser can be used with similar specifications.

Figure 8:
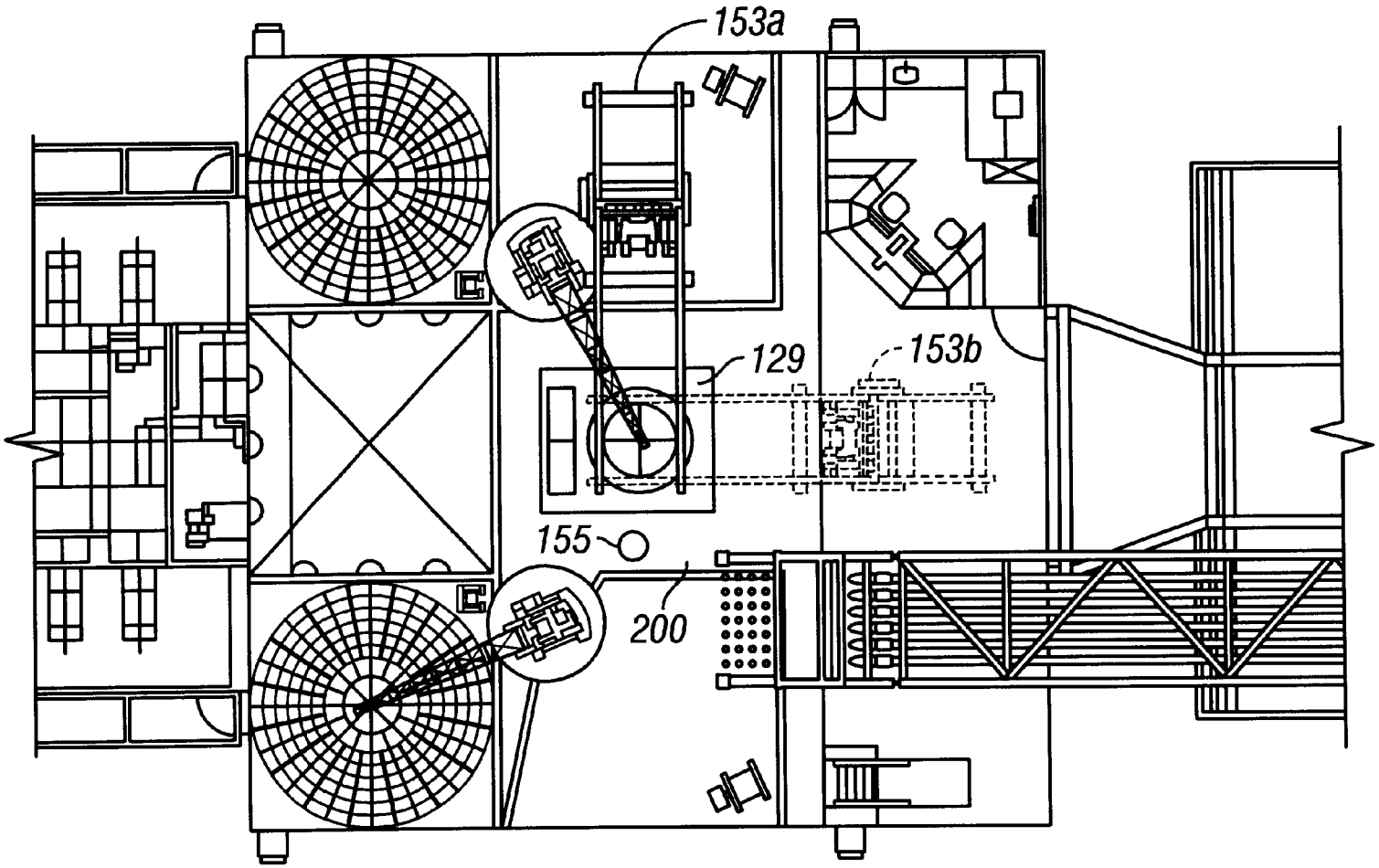
FIG. 8 is a top view of the preferred two positions for an iron roughneck and the location of a removable snubbing post.

FIG. 8 shows the preferred two positions for an iron roughneck and the location of a removable snubbing post (155). The two preferred positions for the iron roughneck are shown as (153*a*) and (153*b*). The positions of the recoverable snubbing post (155), the base structure (200), and the rotary work table (129) with relation to the iron roughneck configurations also are shown in FIG. 8. The rotary worktable can orient the iron roughneck to a first and second position, wherein one position permits the tubulars to be lifted to a vertical position from the catwalk using a drawworks. Preferably, the first position is 90 degrees from the second position.

The mooring and semisubmersible MPU system further contemplates using a measurement system, either on the semisubmersible MPU or otherwise situated, to record exact distance and spatial relationship between the semisubmersible MPU and the production platform. It also contemplates using a camera system, which allows the semisubmersible MPU, production platform, hawsers, hawser guidance system and related equipment to be monitored. Finally, the semisubmersible MPU may have installed on it, or the system may include, a monitoring system to analyze any variations in tension on the connecting means of the semisubmersible MPU.

The semisubmersible MPU of the present invention can be connected to a wide variety of production platforms. If connected to a deep draft caisson vessel, such as a SPAR, it comprises:

1. a deck;
2. a multipurpose tower removably secured to the deck, comprising at least two members of the group consisting of a base structure, a tower, and a crown, a drawworks line, drawworks for hoisting the drawworks line secured to the multipurpose tower; a top drive mounted on the tower; blocks secured to the tower; a control cabin connected to the tower, and a heave compensator;
3. a crane secured to the deck;
4. a configuration that results in a combined environmental load of less than 1000 kips within a 100-year extreme weather condition;
5. a plurality of supports, each with a rounded shape, connected to the deck;
6. a plurality of pontoons connected to the supports, each pontoon being capable of ballast transfer;
7. at least two hawsers for connecting the semisubmersible MPU to the SPAR, each hawser having a length which is selected from the group: the length of the semisubmersible MPU, the semisubmersible tendering distance, the length of the SPAR, and combinations thereof, wherein each of the hawsers has sufficient elasticity to accommodate the wave frequency between the SPAR and the semisubmersible MPU, and sufficient stiffness to synchronize the mean and low frequency movements between the SPAR and the semisubmersible MPU under an environmental load produced during a storm having a designation of up to a 10-year winter storm in the semisubmersible tendering position, and wherein the hawsers remain slack during a storm designed as at least a 10-year storm for the semisubmersible MPU in the semisubmersible tender standby position;
8. connecting means mounted on the semisubmersible MPU securing a first end of each hawser;
9. a hawser guidance system for each hawser to direct each hawser to the SPAR;
10. an at least 8-point mooring system for the semisubmersible MPU, and
11. means for creating global equilibrium between the SPAR's mooring system and the at least 8-point mooring system of the semisubmersible MPU.

For the TLP embodiment, the semisubmersible MPU with multipurpose tower further comprises:

1. a deck;
2. a multipurpose tower removably secured to the deck, where the tower comprises at least two members of the group consisting of: a base structure, a tower, and a crown; a drawworks line, drawworks for hoisting the drawworks line secured to the multipurpose tower; a top drive mounted on the tower; blocks secured to the tower; a control cabin connected to the tower, and a heave compensator;
3. a crane secured to the deck;
4. a configuration that results in a combined environmental load of less than 1000 kips within a 100-year extreme weather condition comprising:
   a. a plurality of supports each with a rounded shape connected to the deck, and
   b. a plurality of pontoons connecting the supports, each pontoon being capable of ballast transfer;
5. at least two hawsers for connecting the semisubmersible MPU to the TLP, each hawser having a length which is selected from the group: the length of the semisubmersible MPU, the semisubmersible tendering distance, the length of the tension leg production platform, and combinations thereof; wherein each of the hawsers has sufficient elasticity to accommodate the wave frequency between the TLP and the semisubmersible MPU, and sufficient stiffness to synchronize the mean and low frequency movements between the TLP and the semisubmersible MPU under an environmental load produced during a storm having a designation of up to a 10-year winter storm in the semisubmersible tendering position, and wherein the hawsers remain slack during a storm designated as at least a 10-year storm or greater for the semisubmersible MPU in the semisubmersible tender standby position;
7. connecting means mounted on the semisubmersible MPU and securing a first end of each hawser;
8. a hawser guidance system for each hawser to direct each the hawser to the TLP; an at least 6-point mooring system for the semisubmersible tender;
9. an at least one auxiliary mooring line for tensioning the TLP; and
10. means for creating global equilibrium between the TLP's tethers, tensioning line and mooring system, and the at least 6-point mooring system of the semisubmersible MPU.

If a compliant tower production platform is used, the semisubmersible MPU with multipurpose tower comprises:

1. a deck;
2. a multipurpose tower removably secured to the deck, where the tower comprises at least two members of the group consisting of: a base structure, a tower, and a crown; a drawworks line, drawworks for hoisting the drawworks line secured to the multipurpose tower; a top drive mounted on the tower, blocks secured to the tower; a control cabin connected to the tower, and a heave compensator;

3. a crane secured to the deck;
4. a configuration that results in a combined environmental load of less than 1000 kips within a 100-year extreme weather condition;
5. a plurality of supports each with a rounded shape connected to the deck;
6. a plurality of pontoons connecting the supports, each pontoon being capable of ballast transfer;
7. at least two hawsers for connecting the semisubmersible MPU to the compliant tower production platform, each hawser having a length which is selected from the group: the length of the semi submersible MPU, the semisubmersible tendering distance, the length of the compliant tower production platform, and combinations thereof; and wherein the hawsers have sufficient elasticity to accommodate the wave frequency between the compliant tower and the semisubmersible MPU, and sufficient stiffness to synchronize the mean and low frequency movement between the compliant tower and the semisubmersible MPU under an environmental load produced during a storm having a designation of up to a 10-year winter storm in the semisubmersible tendering position, and wherein the hawsers remain slack during a storm designated as at least a 10-year storm for the semisubmersible MPU in the semisubmersible tender standby position;
8. connecting means mounted on the semisubmersible MPU and securing a first end of each hawser;
9. a hawser guidance system for each hawser to direct each the hawser to the compliant tower;
10. an at least 6-point mooring system for the semisubmersible MPU;
11. an at least one tensioning or auxiliary mooring line for the compliant tower to provide tension to the semisubmersible MPU, and
12. means for creating global equilibrium between the compliant tower and the at least 6-point mooring system of the semisubmersible MPU.

The semisubmersible MPU with multipurpose tower can be used for a fixed leg production platform and can comprise:

1. a deck;
2. a multipurpose tower removably secured to the deck, where the tower comprises at least two members of the group consisting of a base structure, a tower, and a crown; a drawworks line, drawworks for hoisting the drawworks line secured to the multipurpose tower, a top drive mounted on the tower, blocks secured to the tower, a control cabin connected to the tower, and a heave compensator;
3. a crane secured to the deck;
4. a configuration that results in a combined environmental load of less than 1000 kips in a 100-year extreme weather condition;
5. a plurality of supports each with a rounded shape connected to the deck;
6. a plurality of pontoons connecting the supports, each pontoon being capable of ballast transfer;
7. at least two hawsers for connecting the semisubmersible MPU to the fixed leg production platform, each hawser having a length which is selected from the group: the length of the semisubmersible MPU, the semisubmersible tendering distance, the length of the fixed leg production platform, and combinations thereof, wherein the hawsers have sufficient elasticity to accommodate the wave frequency between the fixed leg production platform and the semisubmersible MPU, and sufficient stiffness and tension to synchronize the mean and low frequency movement between the fixed leg production platform and the semisubmersible MPU under an environmental load produced during a storm having a designation of up to a 10-year winter storm in the semisubmersible tendering position, and wherein the hawsers remain slack during a storm designated as at least a 10 year storm for the semisubmersible MPU in the semisubmersible tender standby position;
8. connecting means mounted on the semisubmersible MPU and securing a first end of each hawser;
9. a hawser guidance system for each hawser to direct each hawser to the fixed leg production platform;
10. an at least 6-point semisubmersible tender mooring system for the semisubmersible MPU, and
11. means for creating global equilibrium between the fixed leg production platform and the at least 6-point mooring system of the semisubmersible MPU.

The semisubmersible MPU with multipurpose tower that can be used for a semisubmersible tendering to another semisubmersible production platform can comprise:

1. a deck;
2. a multipurpose tower removably secured to the deck, where the tower comprises at least two members of the group consisting of: a base structure, a tower, and a crown; a drawworks line, drawworks for hoisting the drawworks line secured to the multipurpose tower, a top drive mounted on the tower's blocks secured to the tower, a control cabin connected to the tower, and a heave compensator;
3. a crane secured to the deck;
4. a configuration that results in a combined environmental load less than 1000 kips in a 100-year extreme weather condition;
5. a plurality of supports each with a rounded shape, connected to the deck;
6. a plurality of pontoons connecting the supports, each pontoon being capable of ballast transfer;
7. at least two hawsers for connecting the semisubmersible MPU to the semisubmersible production vessel, each hawser having a length which is selected from the group: the length of the semisubmersible MPU, the semisubmersible tendering distance, the length of the semisubmersible production vessel, and combinations thereof, wherein each hawser has sufficient elasticity to accommodate the wave frequency between the semisubmersible production vessel and the semisubmersible MPU, and sufficient stiffness to synchronize the mean and low frequency movement between the semisubmersible production vessel and the semisubmersible MPU under an environmental load produced during a storm having a designation of up to a 10-year winter storm in the semisubmersible tendering position, and wherein the hawsers remain slack during a storm designated as at least a 10-year storm for the semisubmersible MPU in the semisubmersible tender standby position;
8. connecting means mounted on the semisubmersible MPU and securing a first end of each hawser;
9. a hawser guidance system for each hawser to direct each hawser to the semisubmersible production vessel;

10. an at least 6-point semisubmersible tender mooring system for the semisubmersible MPU, and
11. means for creating global equilibrium between the semisubmersible production vessel's mooring system and the at least 6-point mooring system of the semisubmersible MPU.

Figure 9:
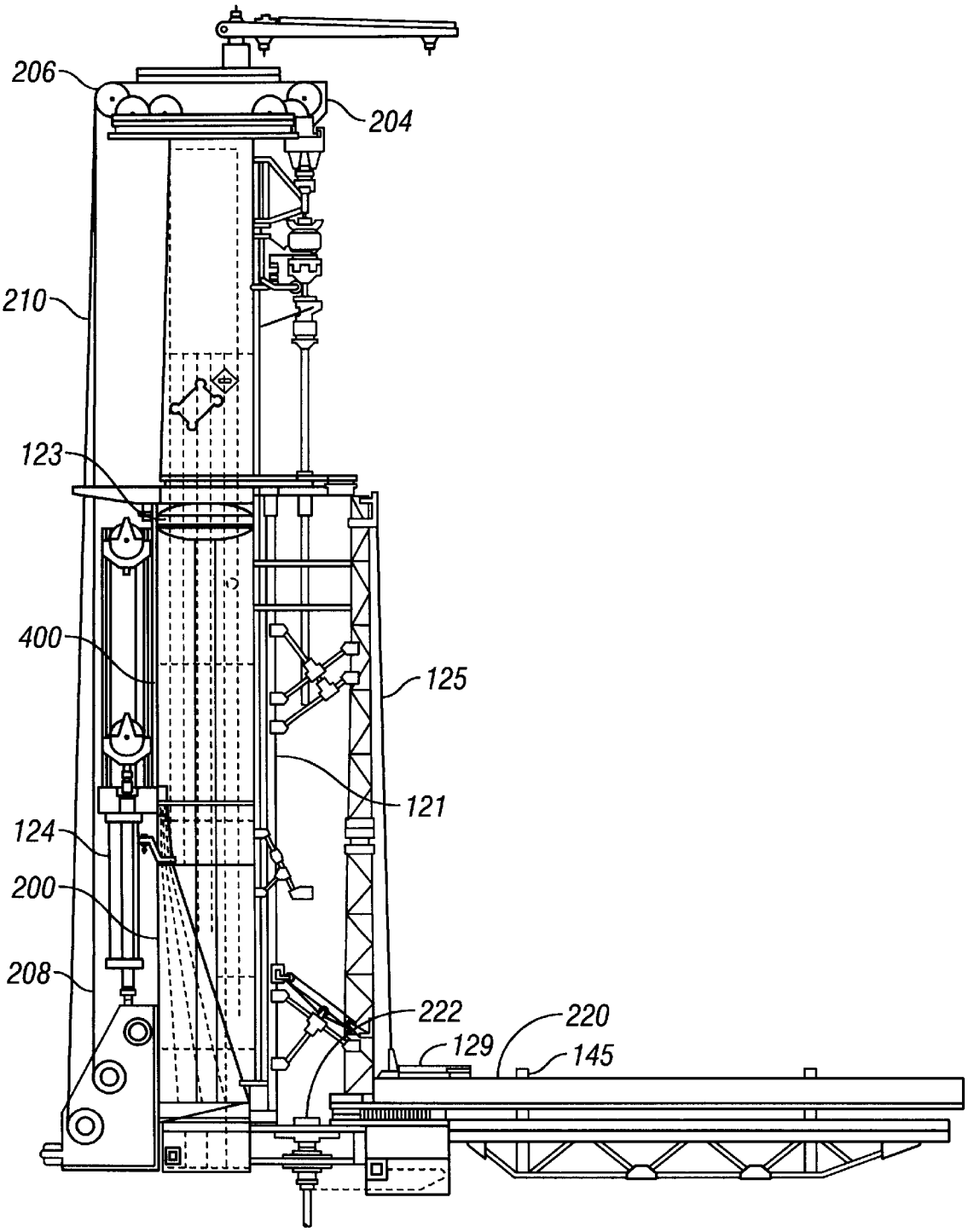
FIG. 9 is a side view of a multipurpose tower erected on a multipurpose unit.

FIG. 9 shows a driller's cabin module (220) that either can be integrated into the tower or kept apart and electronically connected to the tower. A removable drill floor with a removable hatch (222) sits in the base structure (200) and supports a rotary work table (129) that can be hydraulically driven to permit the hanging of pipe or similar tubulars using the tower (400). When the tower (400) is located on the MPU, additional motion or heave compensators (124) can be used with the tower to stabilize the block during use. These motion compensators, or passive heave stabilizers are of the conventional type, with a plurality of charged cylinders with air, hydraulic fluids or nitrogen contained in the cylinders. Active heave compensators can be used and integrated into the drawworks, utilizing sensors to pay out or pull in the drawworks line depending on movement of the tower. Optional racking drums or boards can be secured to the tower to receive work-over or completion tubing piping. The semisubmersible tender can have one tower, or two towers and still work. Optionally, automatic racking arms also can be used on the tower. FIG. 9 also shows the positions of the sheave (206), the crown (204), the drawworks line (210), the setback drum (123), the pipe racker (121), the upending table (125), and the catwalk (145). The tower is located on the base structure (200).

Figure 11:
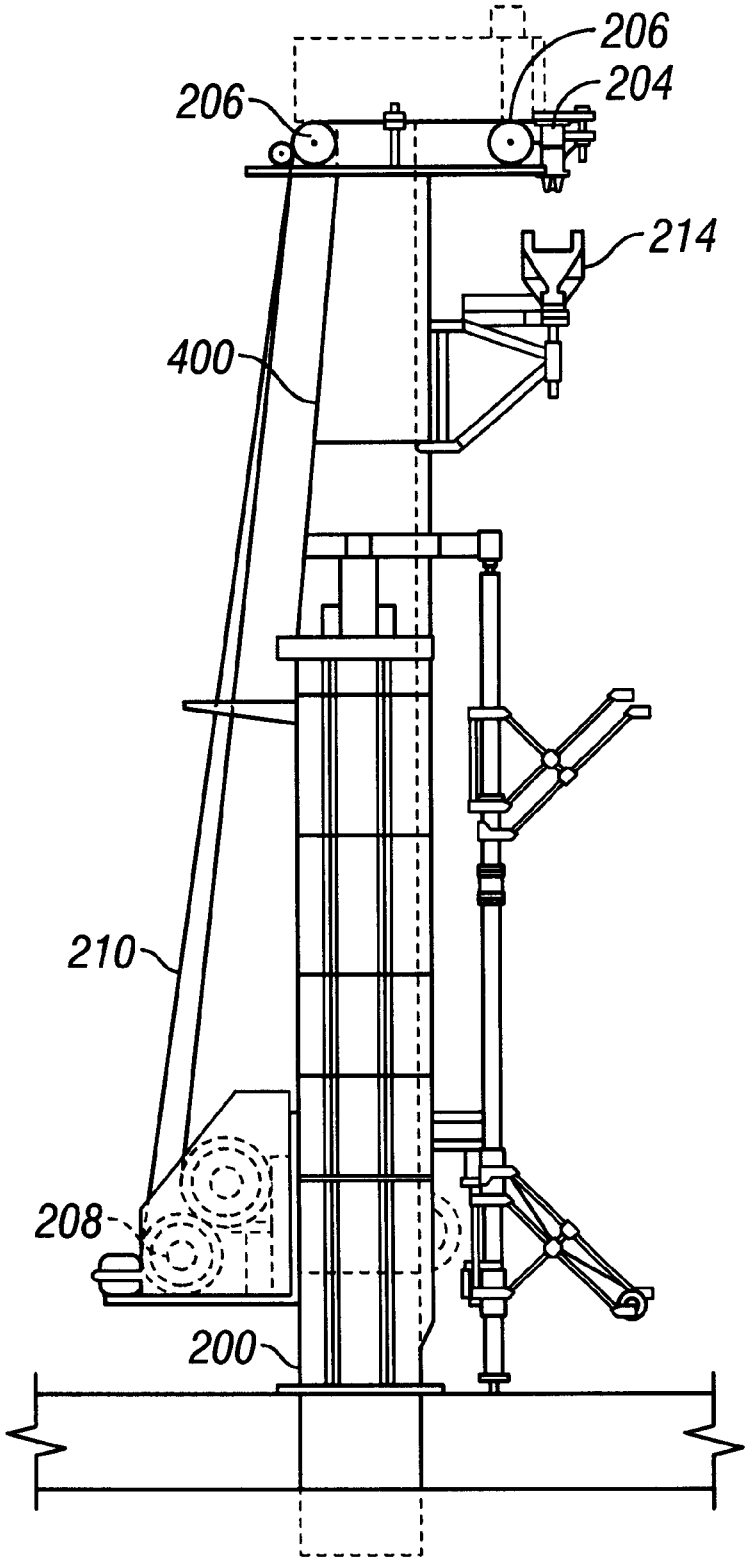
FIG. 11 is a cross-sectional view of another embodiment of a multipurpose tower.

FIG. 11 shows another embodiment of the tower (400). FIG. 11 is the cross-sectional view of the tower shown in FIG. 9. FIG. 11 shows the positional relationship of the sheave (206), the crown (204), the drawworks (208), and the attached drawworks line (210). The tower is located on the base structure (200).

Figure 12:
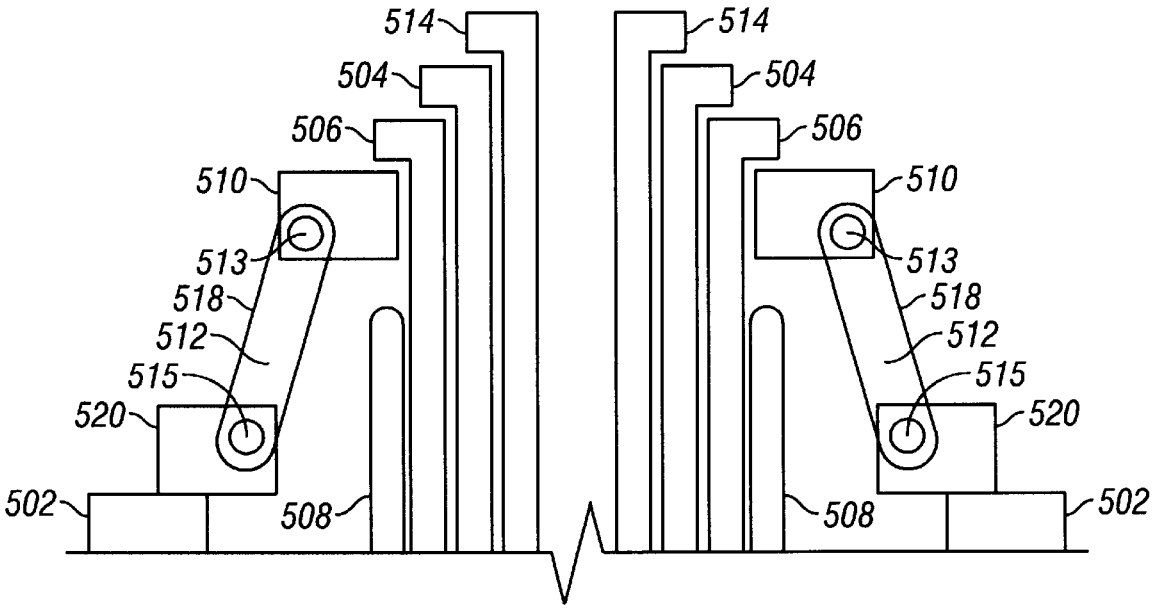
FIG. 12 is a cross section of the tensioning slip joint for a surface BOP.

FIG. 12 shows the top view of the multipurpose unit connected to the tensioning slip joint disposed in the moon pool having a structural box (502) and a high-pressure riser (514) comprised of the following:

1. a tension slip joint with an inner barrel (504) connected to the high-pressure riser and an outer barrel (506);
2. tensioning cylinders (508) connected to the outer barrel;
3. riser tensioning cart (510) disposed adjacent the moon pool;
4. gimbal system (512) connected to the tensioning cylinders and the riser tensioning cart.

The multipurpose components, the base structure, the tower and the crown preferably are hydraulically pinned (513) together. It is contemplated that the multipurpose tower may be of a lattice construction. The tensioning cylinders preferably are a combination of hydraulic and gas cylinders. Preferably, between 6 and 9 tensioning cylinders are used in the present invention.

The MPU also can be connected to a connected to the tensioning slip joint disposed in the moon pool having a structural box (502) and a low pressure driller riser, the tensioning slip joint comprising:

a. an inner barrel;
b. an outer barrel connected to said low pressure drilling riser for vertical movement control, said outer barrel overlapping said inner barrel;
c. a riser-tensioning cart disposed adjacent the moon pool;
d. a plurality of tensioning cylinders connected to the outer barrel, and
e. a gimbal system connected to the riser tensioning cart and the tensioning cylinders.

Figure 13:
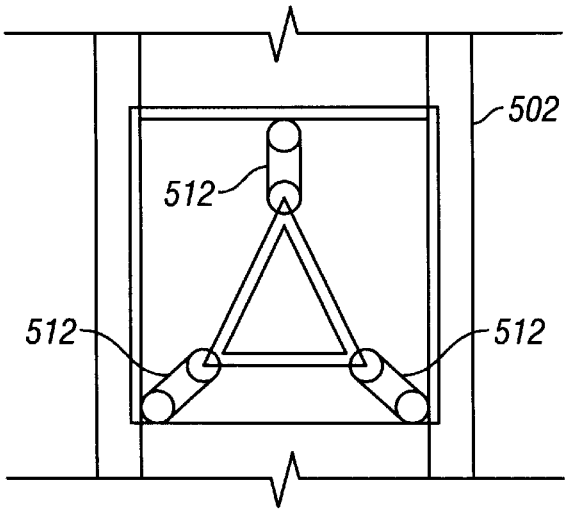
FIG. 13 is perspective view of the tensioning slip joint gimbal and cart positioned in a moon pool.

FIG. 13 is top view of the tensioning slip joint for a surface BOP as shown in FIG. 12. Most evident in FIG. 13 is the positional relationship of the structural box (502) and the gimbal system (512) as well as the triangular configuration of the gimbal system. The gimbal system comprises a gimbal base, a first pin, an arm, a second pin and a gimbal frame. The riser-tensioning cart can be mounted to rails that slide adjacent the moon pool.

Figure 14:
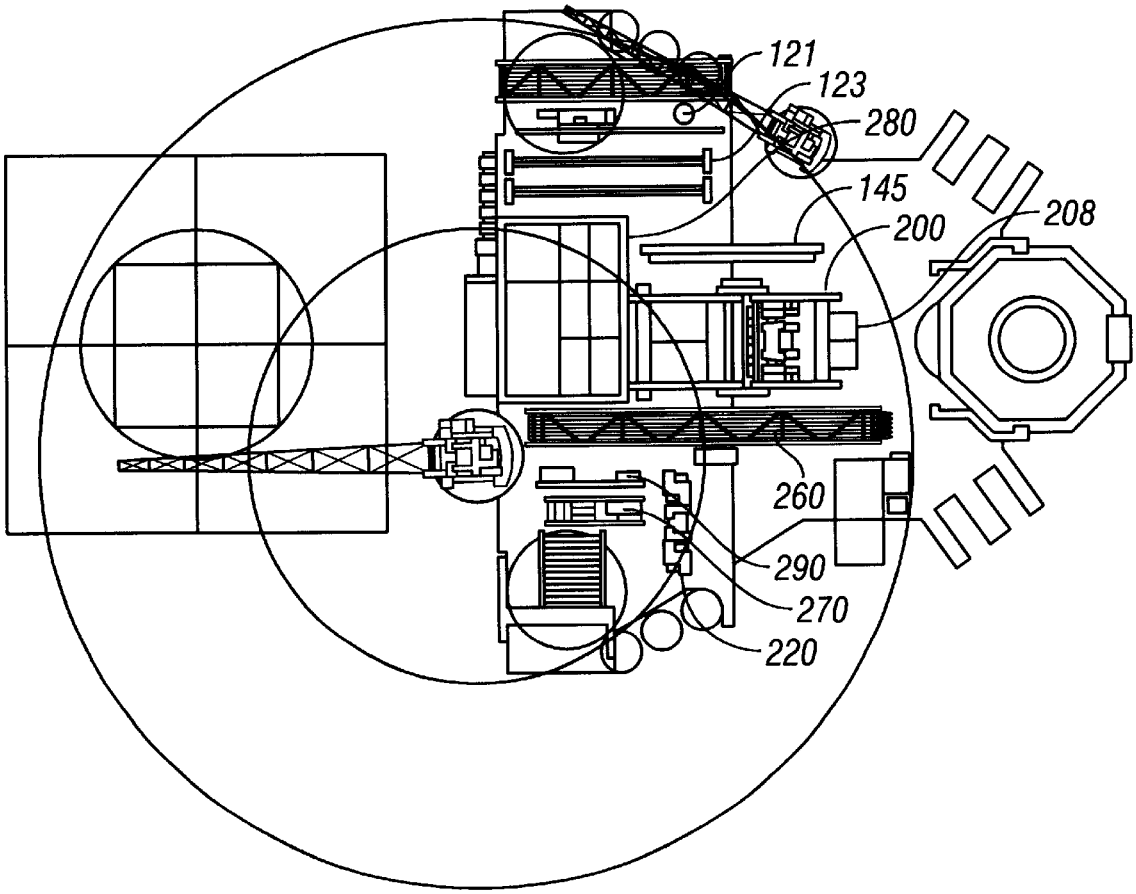
FIG. 14 is a top view of a preferred tower laid on the deck of a multipurpose unit.

FIG. 14 is a top view of a preferred tower on a multipurpose unit. FIG. 14 shows the positional relationship of the pipe racker (121), the setback drum (123), drawworks (208), and catwalk (145). The figure also shows where those items are placed on the skid frame (280) and base structure (200). FIG. 14 also shows the location of the cellar deck module (260), the mud module (290), the BOP module (270), and the driller's cabin module (220). The tower is located either over or beside the moon pool of the semisubmersible MPU, or the tower is cantilevered on the side of the semisubmersible MPU and able to be positioned to slide or skid over the moon pool or from one side to the other of the semisubmersible MPU. A service crane can be disposed on the multipurpose tower. In addition, it is contemplated that a modular tower is within the scope of this invention.

Figure 15:
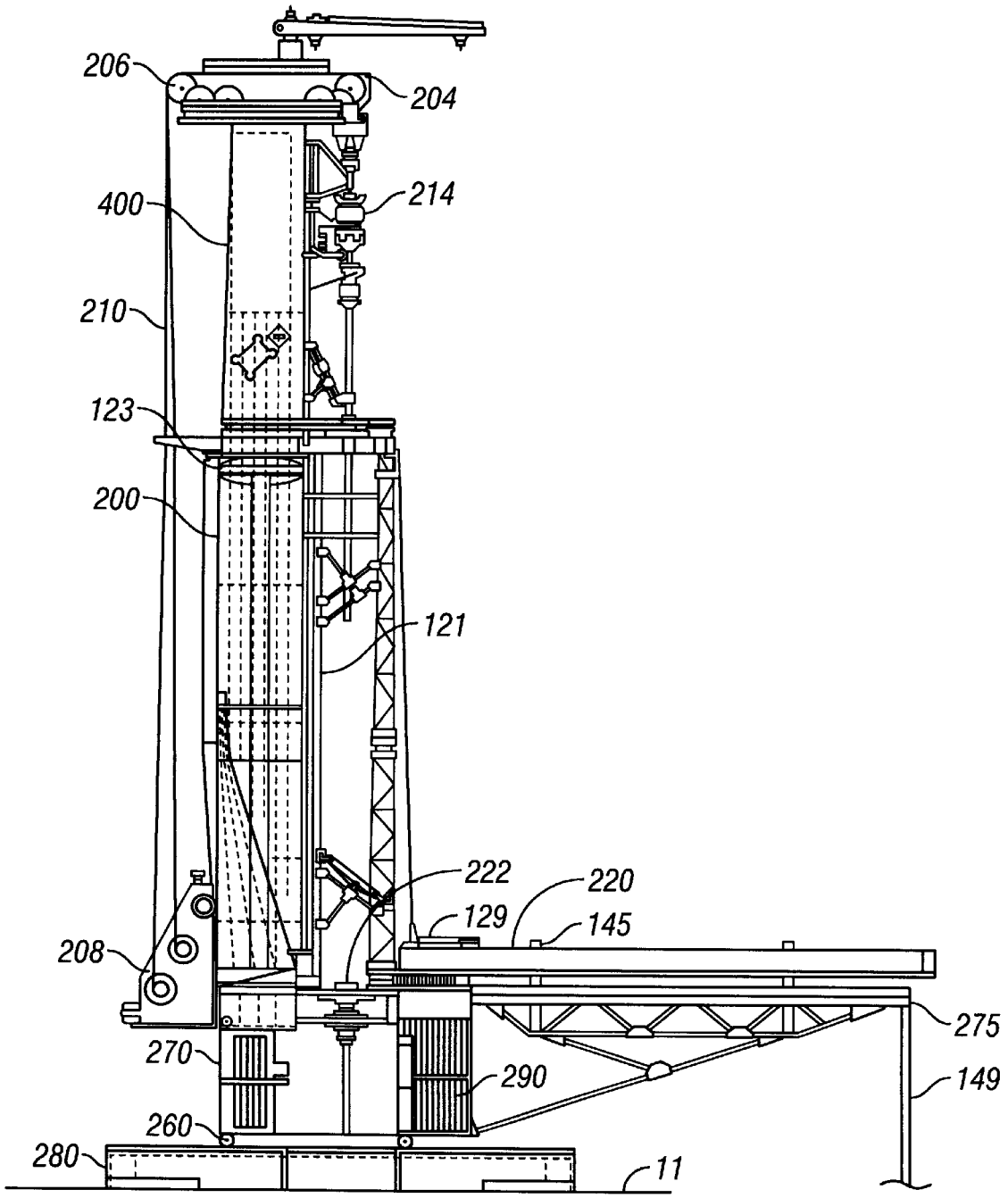
FIG. 15 is a side view of a multipurpose tower on a production platform.

FIG. 15 shows the tower (400) in cross-section with base structure (200), a tower (400), and a crown (204). On the crown (204), a sheave (206) runs the drawworks line (210) from drawworks (208), which hangs on or is attached to the tower. The drawworks line can be run on the exterior of the tower or on the interior of the tower. A top drive (214) is disposed on the top of the tower and runs on a set of rails. A traveling block can be diposed on the rails and engage the top drive (214). FIG. 15 also shows the position of the setback drum (123), the pipe racker (121), the rotary work table (129), and the catwalk (145). The tower sits atop the skid frame (280). The skid frame sits on the SPAR structure (11). FIG. 15 also shows the location of the various modules including the cellar deck module (260), the BOP module (270), the driller's cabin (220), and the mud module (290). Further, FIG. 15 shows the location of the drill floor with a hatch cover (122), the service porch (275), and the service umbilicals (149). The service porch holds and supports the service umbilicals and operationally supports the MPT. The service porch can be in the form of a catwalk. The catwalk comprises piping through which electric lines, fluid lines and other material can be passed and operationally support the tower. The service porch further comprises a container skidding system for receiving second tubular containers and supporting them on the service porch and skidding them to the upending table.

Various methods for using the semisubmersible MPU with multipurpose tower are contemplated within the scope of this invention. These methods include:

1. coil tubing intervention;
2. removal of subsea Christmas trees; and
3. completion of a subsea well.

Specifically, coil tubing intervention involves the following steps:

1. close subsurface safety control value;
2. close the master valve on the tee;
3. deploy ROV (remotely operated vehicle), inspect tree, pull tree corrosion cap and inspect BOP (blow-out protector) connector;
4. run 11" subsea BOP stack and 9" high-pressure well intervention riser;

5. latch BOP on tree and nipple up coil tubing injector head, BOP and high-pressure lubricator;
6. open master valve on tree and subsurface safety control valve and record stabilized pressure at surface;
7. run in the hole with coil tubing to specified depth;
8. displace tubing with nitrogen to specified depth and record stabilized pressure at surface;
9. repeat procedure at successively deeper depths until target surface pressure is recorded;
10. pull out of hole with coil tubing;
11. close subsurface safety control valve and master valve;
12. pull BOP and riser;
13. set corrosion cap with ROV and subsea tugger; and
14. open subsurface safety control valve and master valve and resume production.

Specifically, removal of subsea Christmas trees involves the following steps:

1. close subsurface safety control value;
2. close the master valve on the tree;
3. deploy ROV, inspect tree, pull tree corrosion cap and inspect BOP connector;
4. run 11" subsea BOP stack and 9" high-pressure well intervention riser;
5. latch BOP on tree and nipple up surface well intervention BOP;
6. open master valve on tree while rigging up wire line;
7. run in the hole with tubing plug on wire line and set in hanger profile;
8. disconnect Tree, pull to surface, and set back for refurbishment;
9. pick-up new Tree and run to sea floor;
10. connect Tree to wellhead, function and pressure test same;
11. run in hole with wire line and retrieve tubing plugs;
12. pull BOP and riser;
13. set corrosion cap with ROV and subsea tugger; and
14. open subsurface safety control valve and master valve and resume production.

Specifically, completion of the subsea well involves the following steps:

1. move the semisubmersible tender and rig over the well;
2. pick up the work string and trip into the hole;
3. pull out the corrosion cap, preferably assisted by an ROV;
4. trip in the hole with a wash tool, and clean and inspect the wellhead;
5. rig up the riser running tools and move an 11-inch subsea completion BOP with a subsea wellhead adapter under the tower;
6. run an 11-inch BOP using a 9⅝ inch high-pressure riser with a ball joint, stress joint, tensioner slip joint;
7. land the BOP on the well;
8. secure the surface systems and test the BOP;
9. pick up the completion work string;
10. isolate the well preparatory fluid system from the sterile completion fluid system; p1 11. trip in the hole to clean out the 9⅝" casing to the bottom;
12. circulate the hole clean and trip out of hole;
13. rig up a wire line and run cement bond logs;
14. run a casing scraper, use a bristle brush and displace the hole with sterile completion fluid;
15. rig up the wire line, make gamma ray trip and set sump packer;
16. test the BOP;
17. trip in hole with tubing conveyed perforating guns, perforate, flow back and trip out of hole;
18. trip in hole with gravel pack assembly and fracture gravel pack;
19. trip of out hole, lay down work string and gravel pack tools;
20. pick up and run chrome tubing and flat packs;
21. set tubing hanger and tubing plugs;
22. pull 9⅝ inch high-pressure riser and 11 inch BOP;
23. move subsea completion tree under the tower;
24. run subsea completion tree with high-pressure riser;
25. install tree control lines, function test tree and close lower subsurface control valve;
26. install and pull in flex flowlines and control umbilical;
27. pull plugs from tubing hanger;
28. run in hole with coil tubing and displace tubing down to lower subsurface control valve;
29. pull coil tubing, and close tree master valve;
30. pull high-pressure riser; and
31. install completion tree corrosion cap and fill with corrosion fluid and install debris cap.

The invention also relates to a method for erecting a disassembled multipurpose tower from the deck of a multipurpose unit (MPU) to a platform, wherein said MPU comprises: a deck, a plurality of supports having a rounded shape connected to the deck, a plurality of pontoons connected to the supports with each pontoon adapted for ballast transfer; at least two hawsers connected to the MPU for connecting the MPU to an object at sea having a mooring system, a hawser guidance system to direct each hawser to the object at sea; a crane secured to the deck of the MPU multipurpose tower removably secured to the deck wherein said tower comprises a base structure mounted in the deck, a tower mounted to the base structure, a top drive mounted to the tower, a drawworks secured to the tower; and a driller's cabin module mounted in the deck connected to the base structure; and wherein said crane has a slew ring, wherein the method of erecting a disassembled MPT tower comprises the following steps:

1. mooring a multipurpose unit in proximity to a deep draft caisson vessel (DDC), wherein said DDC has a main deck, skid beams mounted on the deck, and a preset mooring system;
2. connecting the DDC to the multipurpose unit (MPU);
3. de-ballasting the DDC to a first depth;
4. ballasting the MPU to a first draft wherein the slew ring of the crane is approximately level with the deck of the DDC;
5. placing a skid frame on the skid beams on the DDC using the crane;
6. placing a cellar module on the skid frame;
7. placing a BOP module on the cellar module;
8. placing a mud module on the cellar module;
9. placing a base frame on the mud module and the BOP module;
10. connecting the drawworks to the base frame;
11. placing the driller's cabin module on the mud module;

12. connecting a service porch to a driller's cabin module;
13. placing the tower on the service porch and connecting it to the base frame;
14. erecting the tower with the drawworks;
15. connecting setback drums to the tower;
16. connecting a pipe racker to the tower; and
17. connecting the upending table to the driller cabin module.

The invention also relates to a method for disassembling an erected multipurpose tower on a platform and removing and reassembling the tower on a multipurpose unit (MPU), wherein said MPU comprises: a deck, a plurality of supports having a rounded shape connected to the deck, a plurality of pontoons connected to the supports with each pontoon adapted for ballast transfer; at least two hawsers connected to the MPU for connecting the MPU to an object at sea having a mooring system, a hawser guidance system to direct each hawser to the object at sea; a crane secured to the deck of the MPU; a multipurpose tower removably secured to the deck, wherein said MPT comprises a base structure mounted in the deck, a tower mounted to the base structure, a top drive mounted to the tower, a drawworks secured to the tower; and a driller's cabin module mounted in the deck connected to the base structure; wherein said method of disassembling and erected MPT comprises the steps of:

1. removing the upending table and placing it on the deck of the multipurpose unit (MPU);
2. removing the pipe rackers and placing them on the deck of the MPU;
3. removing the drum s and placing them on the deck of the MPU;
4. lowering the tower using a drawworks onto the deck of the MPU;
5. disconnecting the tower from the base frame;
6. picking up the tower onto the deck of the MPU;
7. removing the drawworks onto the deck of the MPU;
8. removing the driller's module onto the deck of the MPU;
9. removing the base frame onto the deck of the MPU;
10. connecting the drawworks to the base frame;
11. skidding the base frame over a moon pool;
12. picking up the driller's control and connecting it to the base frame on the deck over the moon pool;
13. picking up the tower and connecting the tower to the base frame;
14. raising the tower to a vertical position using the drawworks;
15. connecting a passive heave compensator to the tower;
16. connecting setback drums to the tower;
17. connecting a pipe racker to the tower;
18. connecting the upending table to the driller cabin module;
19. removing the mud module and placing it on the deck;
20. removing the BOP module and placing it on the deck;
21. removing the cellar module and placing it on the deck; and
22. removing the skid frame and placing it on the deck The invention also relates to method for disassembling a multipurpose tower from on a multipurpose unit (MPU) and erecting the tower on a platform, wherein the MPU comprises: a deck, a plurality of supports having a rounded shape connected to the deck, a plurality of pontoons connected to the supports with each pontoon adapted for ballast transfer; at least two hawsers connected to the MPU for connecting the MPU to an object at sea having a mooring system, a hawser guidance system to direct each hawser to the object at sea; a crane secured to the deck of the MPU; a multipurpose tower removably secured to the deck wherein said tower comprises a base structure mounted in the deck, a tower mounted to the base structure, a top drive mounted to the tower, a drawworks secured to the tower, and a driller's cabin module mounted in the deck connected to the base structure, wherein the method for disassembling a multipurpose tower from on a multipurpose unit (MPU) and erecting the tower on a platform comprises the following steps:

1. placing a skid frame on the platform;
2. placing a cellar module on the skid frame;
3. placing a BOP module on the cellar module;
4. placing a mud module on the cellar module;
5. removing an upending table and placing it on the MPU deck;
6. removing a pipe rackers and placing on the MPU deck;
7. taking the set back drums off the tower and placing them on the deck;
8. removing a heave compensator from the tower and placing it on the MPU deck;
9. lowering the tower with the drawworks and resting it on the MPU deck;
10. removing the tower from the base frame and placing it on the MPU deck;
11. removing the driller's cabin module and placing it onto the deck of the MPU;
12. skidding the base frame close to the crane and removing the drawworks module and placing it on the MPU deck;
13. placing the skid frame onto the mud module and the BOP module;
14. picking up the drawworks connection to the base frame;
15. moving the driller's cabin module from the deck and placing it on the mud module;
16. placing a service porch on the driller's cabin module and the mud module;
17. lifting the tower from the MPU deck and connecting it to the base frame and laying it on the service porch;
18. using the drawworks to lift the tower to the vertical position;
19. hanging the setback drums in the tower;
20. hanging the pipe racker on the tower; and
21. placing the upending table on the driller's cabin module.

The invention also relates a method for disassembling a tower erected on a platform to the deck of a multipurpose unit (MPU) comprising the steps of:

1. de-ballasting the DDC to a first depth;
2. ballasting the MPU to a first draft wherein the slew ring of the crane is approximately level with the deck of the DDC;
3. disconnecting a upending table from a driller's cabin module and placing it on the deck of the MPU;
4. disconnecting a pipe racker from the tower and placing it on the deck of the MPU;
5. disconnecting setback drums from the tower and placing it on the deck of the MPU;

6. lowering the tower with a drawworks to the service porch;
7. disconnecting the tower from a base frame and placing it on the deck of the MPU;
8. disconnecting the service porch from the driller's cabin module and placing it on the deck of the MPU;
9. removing the driller's cabin module from a mud module and placing it on the deck of the MPU;
10. disconnecting the drawworks from the base frame and placing it on the deck of the MPU;
11. removing the base frame from the mud module and BOP module and placing it on the deck of the MPU;
12. removing the mud module from a cellar module and placing it on the deck of the MPU;
13. removing the BOP module from the cellar module and placing it on the deck of the MPU;
14. removing the cellar module from a skid frame and placing it on the deck of the MPU; and
15. removing the skid frame from the skid beams on a deep draft caisson vessel (DDC) using a crane.

The invention also relates to a method for handling tubulars on a semisubmersible comprising the following steps:

1. using approximately 93-ft. tubulars in a 95-ft. container on the MPU deck while the MPU is operating in a MODU, or tender, mode;
2. lifting the container with the crane from the MPU deck and placing it on the catwalk;
3. skidding the container to an upending table;
4. lifting the upending table to a vertical position using the hydraulic cylinders located in the mud module and upending the container forming a vertical container;
5. latching the vertical container to an elevated work platform on the tower;
6. using the racking arm to pull the tubulars from the container; and
7. racking the tubulars onto setback drums or run through the rotary table.

The method of handling tubulars on a semisubmersible MPU further can comprise placing a movable rough neck on a turntable, forming a moveable rough neck assembly adapted to avoid the direct path of tubulars being lifted from the catwalk through to the rotary table.

The invention also relates to a multipurpose tower (MPT) for use on a multipurpose unit (MPU) wherein said MPU comprises a deck, a plurality of supports having a rounded shape connected to the deck, a plurality of pontoons connected to the supports with each pontoon adapted for ballast transfer; at least two hawsers connected to the MPU for connecting the MPU to an object at sea having a mooring system, a hawser guidance system to direct each hawser to the object at sea; a crane removably secured to the deck of the MPU, a multipurpose tower (MPT) removably secured to the deck wherein said MPT comprises a base structure, a tower mounted on the base structure, a crown mounted on the tower, a drawworks line secured to the MPT, a drawworks for hoisting the drawworks line, a top drive mounted to the tower, and a heave compensator; and further wherein a removable motion compensator is disposed on the exterior of the MPT, a plurality of hydraulic cylinders are disposed on the exterior of the MPT, a plurality of sheaves are disposed on the MPT, at least two lines per motion compensator for engaging a drilling string.

Figure 16A:
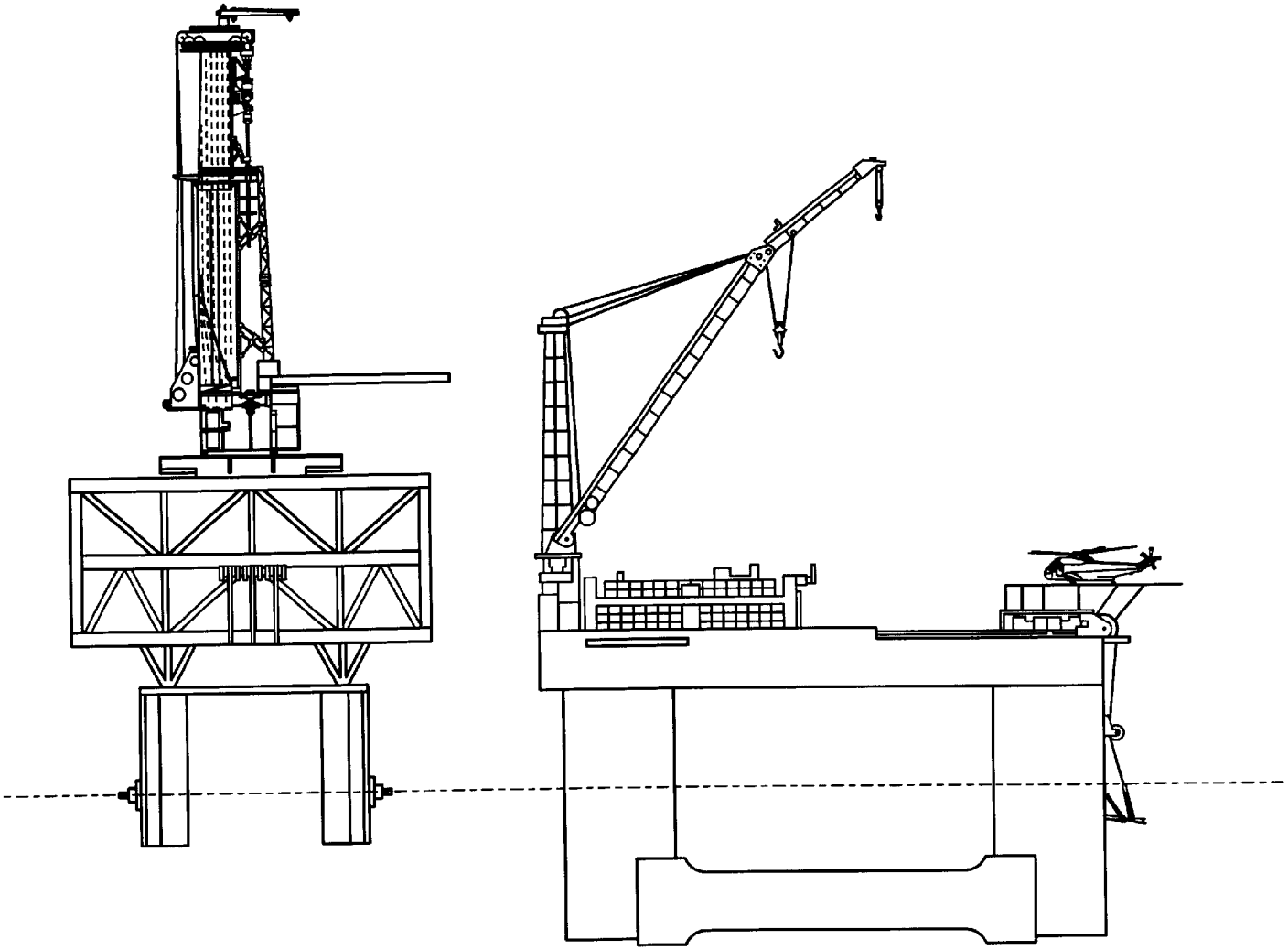
FIG. 16*a* is a first embodiment of a multipurpose tower erected on skid beams of a production platform.
Figure 16B:
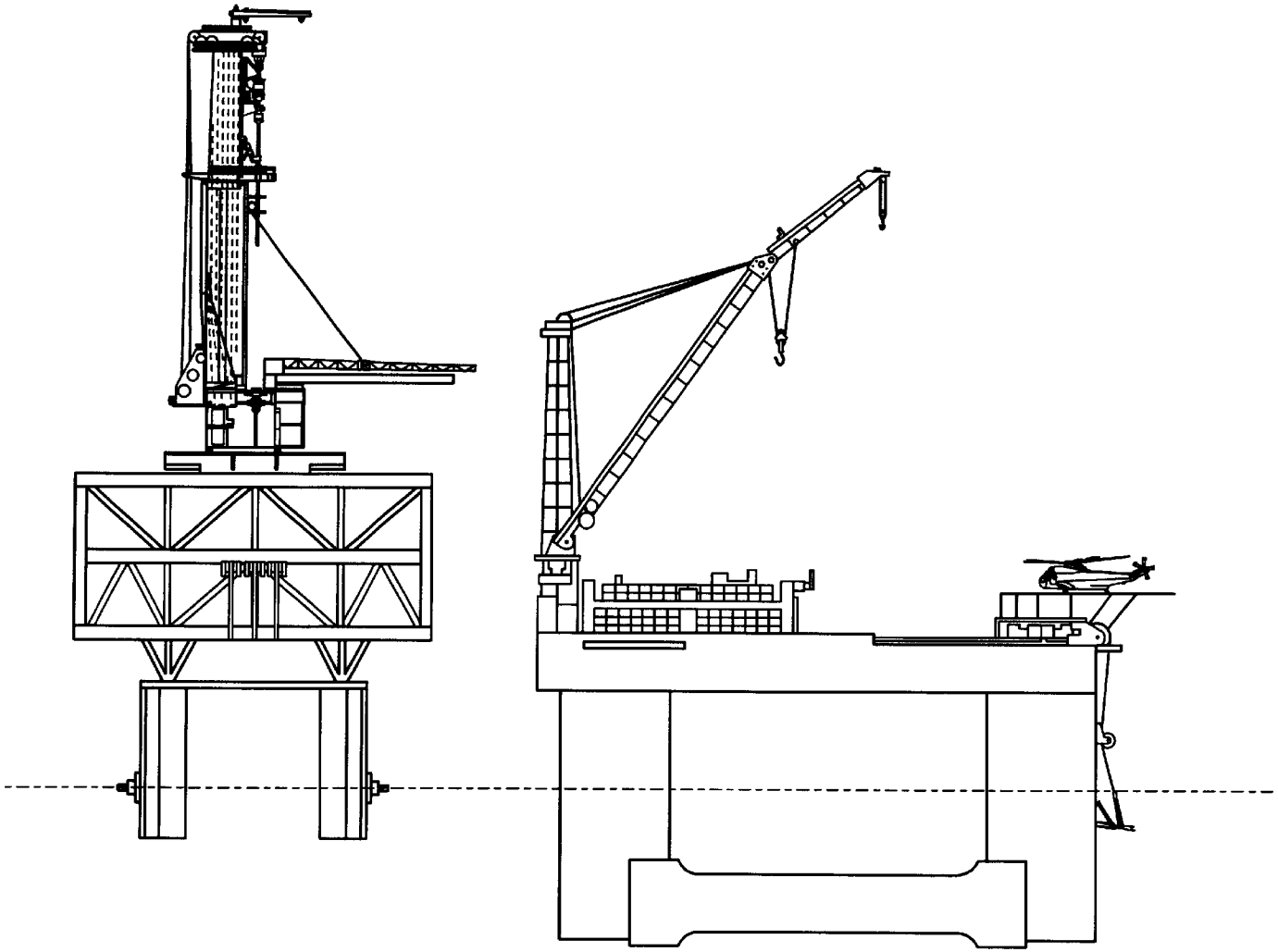
FIG. 16*b* is another embodiment of a multipurpose tower erected within the well bay of a production platform.
Figure 16C:
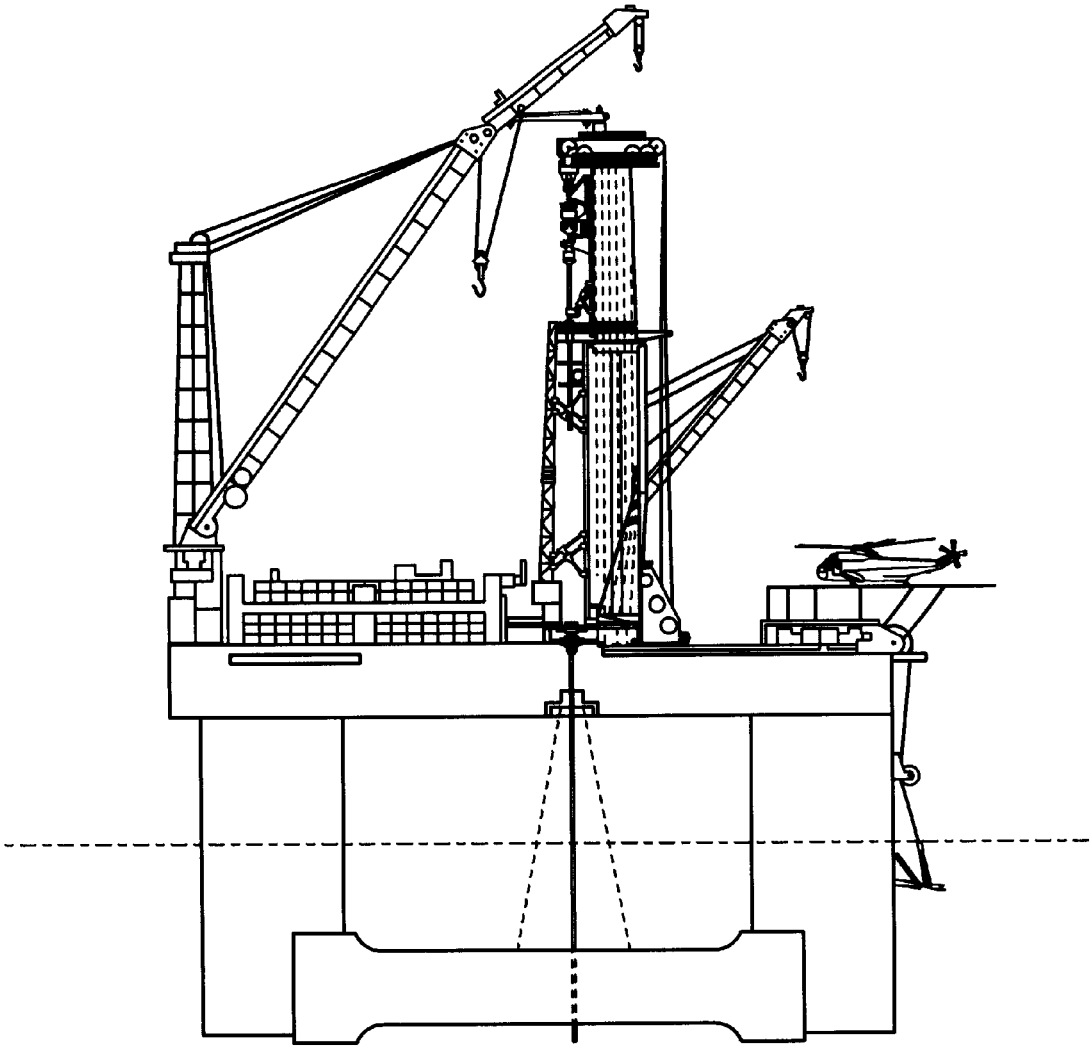
FIG. 16*c* is an erected multipurpose tower erected within the deck of a multipurpose unit.

The invention also relates to a multipurpose tower (MPT) that can be countersunk into the platform. The MPT also can be skiddable from the middle of the multipurpose unit to the side of the multipurpose unit. Finally, the MPT can be mounted on a skid frame either parallel or perpendicular to the plane of movement of the skid frame. It is contemplated that the tower be countersunk into the structural box of the multipurpose unit. The tower is erected into a countersunk drilling platform. The tower can be skiddable from the middle of the production platform to the side. The tower can be mounted up on the skid frame either parallel to or perpendicular to the plane of movement of the skid frame. The cellar box can be positioned in the skid frame on top of the frame or positioned in a countersunk position within the skid frame. FIGS. 16*a*, 16*b*, and 16*c* illustrate and represent the final positions for the tower countersunk into a drilling platform.

The present invention also relates to a method for tensioning a drilling riser with a tower without using a tower tensioning device for a multipurpose unit, the method comprising placing a tensioning riser slip joint having hydraulic cylinders on a riser cart in the moon pool of the multipurpose semisubmersible and activating the hydraulic mechanism to tension the drilling riser.

The invention also relates numerous methods associated with the multipurpose unit. The methods for both erecting and disassembling a multipurpose tower on a multipurpose unit are described in this invention. The invention also relates methods for both erecting and disassembling a multipurpose tower on a drilling platform. The invention describes a method for handling tubulars on a multipurpose unit and a method for tensioning a drilling riser using a multipurpose unit with a moon pool.

Figure 10:
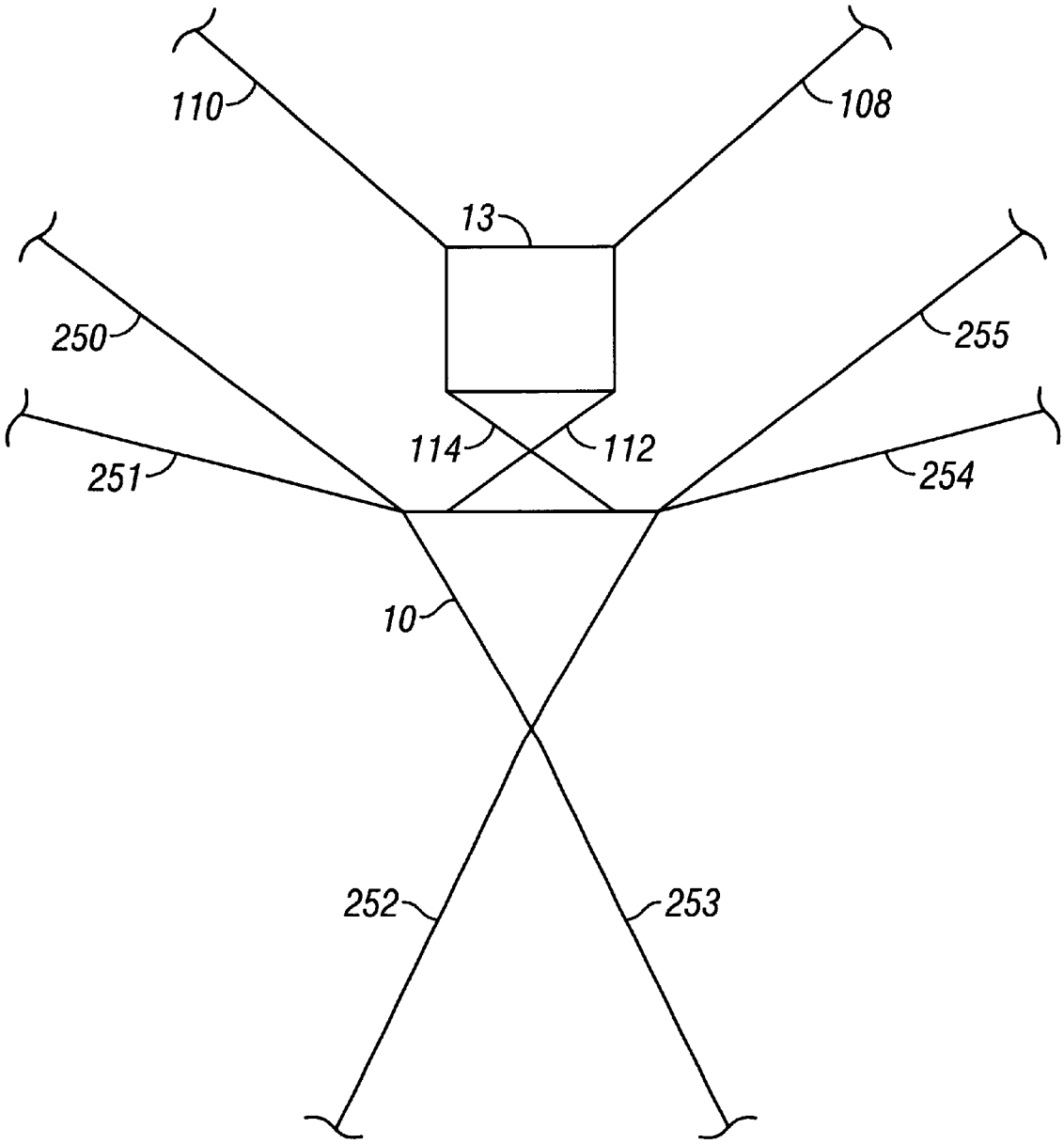
FIG. 10 is a top view of the mooring system with an at least 6-point mooring system connected to a tension leg platform.

The invention also relates to the systems and methods described herein wherein the 8-point mooring system is a 6-point-mooring system. FIG. 10 shows the 6-point mooring system in a calm environment for use when the semisubmersible MPU (10) when is secured to a tension leg. platform (13). FIG. 10 shows the semisubmersible MPU's 6 mooring lines (250), (251), (252), (253), (254), and (255). The TLP's auxiliary mooring lines or tensioning lines are (108) and (110). These tension lines are used as a means to create global equilibrium between the TLP and the semisubmersible MPU. The hawsers (112) and (114) connect the platform and semisubmersible MPU. The TLP's position will be maintained by the use of two mooring legs attached to the TLP on the opposite semisubmersible MPU spread-mooring legs.

The invention relates to a procedure for drilling and completing a well from a deep draft caisson (DDC), such as a SPAR, wherein the multipurpose unit (MPU) is tendered to the DCC in a tender assist mode using an at least 6-point mooring system, comprising the following steps:

1. set skid drilling equipment over a center well slot located on the DDC, while removing the corrosion cap from a subsea wellhead;
2. move the DDC over the subsea wellhead using the DDC's mooring system;
3. lower a drilling riser, which has been parked over the center well slot, and connect the drilling riser to the subsea wellhead;
4. nipple up the surface BOP on the drilling riser;
5. run in the hole with 17½" drilling assembly, drill out a 20" casing, and displace to weighted drilling fluid while drilling the casing shoe;
6. drill a 17½" hole to casing point and pick up drill out of the hole;
7. run a 13⅝41 casing and a casing hanger in wellhead and cement;

8. run in hole with a 12¼" drilling assembly, drill to casing point, and pick up drill out of the hole;
9. run wire line logs;.
10. run a 9⅝" casing and land casing hanger in wellhead and cement;
11. displace cement with seawater and check to ensure casing cement float equipment is working properly;
12. run in hole with a test packer and set below subsea wellhead;
13. pressure test casing, disconnect from test packer, and pick up drill out of the hole in the completion work string;
14. nipple down 18¾" surface BOP and set back on BOP test stump;
15. disconnect drilling riser from subsea wellhead and set in its park position;
16. skid drilling equipment set to the well's designated production slot;
17. trip in hole with wash tool and clean and inspect wellhead;
18. rig-up casing running tools;
19. run a 9⅝ riser with stress joint and keel joint;
20. lock a tieback connector and test;
21. rig-down riser running tools and offload;
22. install a tubing plug;
23. nipple up BOPs and test and set wear bushing;
24. rig-up a wire line, run base line metal thickness, and log across stress & keel joints;
25. pick up a completion work string and trip in hole to clean out 9⅝" casing to bottom and circulate hole with saltwater;
26. rig up and run wire line logs;
27. run a casing scraper/bristle brush and displace hole with completion fluid;
28. rig up wire line logs and set a sump packer;
29. test BOPs;
30. trip in hole with perforating guns, perf, flow back, and trip out of hole;
31. trip in hole with a gravel pack assembly and a gravel pack;
32. trip out of hole and lay down a completion work string and gravel pack tools;
33. pick up and run a chrome tubing, a dual string, and flat packs;
34. set tubing hanger plugs;
35. nipple down BOPs, nipple up tree, flex flowlines and umbilicals;
36. pull plugs, set dual packer, and displace riser with nitrogen; and
37. remove tubing plug and flow back well to platform in order to unload well.

The invention also relates to a method of using a multipurpose unit (MPU) for the purpose of coil tubing intervention wherein the MPU is associated with a subsea well in which is installed a Christmas tree having a corrosion cap, a blow-out preventor (BOP), a master valve, and a subsurface safety control valve, and wherein said MPU comprises a deck, a configuration that results in a combined environmental load less than 1000 kips in a 100-year extreme weather condition, a plurality of supports having a rounded shape and connected to said deck, a plurality of pontoons connecting said plurality of supports, each of said plurality of pontoons being adapted for ballast transfer, and an at least 8-point tender mooring system, said method of coil tubing intervention comprising the steps of:

a. closing said subsurface safety control valve;
b. closing said master valve on the tree;
c. deploying a remotely operated vehicle (ROV) to inspect the tree, pull the tree corrosion cap and inspect the BOP (blow-out protector) connector;
d. running a subsea BOP stack and a high-pressure well intervention riser;
e. latching said BOP on the tree and nippling up the coil tubing injector head, BOP and high-pressure lubricator;
f. opening said master valve and said subsurface safety control valve and recording the stabilized pressure at the surface;
g. running coil tubing in the well hole to a specified depth;
h. displacing said coil tubing with inert gas to another specified depth and recording the stabilized pressure at the surface;
i. repeating the foregoing procedural steps at successively deeper depths until a target surface pressure is recorded;
j. pulling out of the well hole with coil tubing;
k. closing said subsurface safety control valve and said master valve;
l. pulling the BOP and riser;
m. setting the corrosion cap with the ROV and a subsea tugger;
n. opening said subsurface safety control valve and said master valve, and
o. resuming production.

The present invention also relates to a method of using a semi-submersible multipurpose unit (MPU) for the purpose of the removal of a subsea Christmas tree, wherein the MPU comprises a deck, a configuration that results in a combined environmental load less than 1000 kips in a 100-year extreme weather condition, a plurality of supports having a rounded shape and connected to said deck, a plurality of pontoons connecting said plurality of supports, each of said plurality of pontoons being adapted for ballast transfer, an at least 8-point mooring system, wherein said Christmas tree comprises a corrosion cap, a BOP, a master valve and a subsurface safety control valve, said method of removal of a subsea Christmas tree comprising the steps of:

a. closing the subsurface safety control valve;
b. closing the master valve on the tree;
c. deploying a remotely operated vehicle (ROV), inspecting the tree, pulling the tree corrosion cap and inspecting the BOP connector;
d. running a subsea BOP stack and a high-pressure well intervention riser;
e. latching the BOP on the tree and nippling up surface well intervention BOP;
f. opening the master valve on the tree while rigging up wire line;
g. running in the well hole with tubing plug on wire line and setting in a hanger profile;
h. disconnecting the tree, pulling the tree to the surface and setting back for refurbishment;
i picking up a new tree and running it to the sea floor;
j. connecting the new tree to the wellhead, function and pressure testing the new tree;

k. running in the well hole with wire line and retrieving tubing plugs;

l. pulling the BOP and riser;

m. setting the corrosion cap with ROV and subsea tugger;

n. opening the subsurface safety control valve and master valve, and o. resuming production.

The present invention also relates to a method of using a semi-submersible multipurpose unit (MPU) having a modular tower installed thereon, for the purpose of conducting a subsea well intervention operation in a subset well on which there is installed a corrosion cap, said MPU comprising a deck, a configuration that results in a combined environmental load less than 1000 kips in a 100-year extreme weather condition, a plurality of supports each having a rounded shape and connected to said deck, a plurality of pontoons connecting said plurality of supports, each of said plurality of pontoons being adapted for ballast transfer, an at least 8-point mooring system, said method comprising the steps of:

a) moving the tender and rig over the well;

b) picking up the work string and tripping it into the well hole;

c) pulling out the corrosion cap, preferably assisted by an ROV;

d) tripping in the well hole with a wash tool, cleaning and inspecting the wellhead;

e) rigging up the riser running tools and moving an subsea completion BOP with a subsea wellhead adapter under the tower;

f) running a BOP using a high-pressure riser with a ball joint, stress joint, and tensioner slip joint;

g) landing the BOP on the well;

h) securing the surface systems and testing the BOP;

i) picking up the completion work string;

j) isolating the well preparatory fluid system from the sterile completion fluid system;

k) tripping in the hole to clean out the casing to the bottom;

l) circulating the well hole and tripping out of the hole;

m) rigging up a wire line and running cement bond logs;

n) running a casing scraper, using a bristle brush and displacing the hole with sterile completion fluid;

o) rigging up the wire line, making a gamma ray trip and setting up a sump packer;

p) testing the BOP;

q) tripping in the hole with tubing conveyed perforating guns, perforating, flowing back and tripping out of the hole;

r) tripping in the hole with gravel pack assembly and fracturing the gravel pack;

s) tripping out of the hole, laying down a work string and gravel packing tools;

t) picking up and running chrome tubing and flat packs;

u) setting a tubing hanger and tubing plugs in the well bore;

v) pulling a high-pressure riser and an BOP;

w) moving a subsea completion tree under the tower;

x) running the subsea completion tree with a high-pressure riser;

y) installing tree control lines, function testing the tree and closing the lower control valve;

z) installing and pulling in flex flow lines and control umbilicals;

aa) pulling plugs from the tubing hanger;

bb) running in the hole with coil tubing and displacing tubing down to lower a subsurface control valve;

cc) pulling the coil tubing, and closing the tree master valve;

dd) pulling the high-pressure riser;

ee) installing a completion tree corrosion cap and filling with corrosion fluid; and installing a debris cap.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A semisubmersible multipurpose unit (MPU) adapted for use in wellhead surface operations comprising:

a. a deck, a plurality of supports having a rounded shape connected to said deck, a plurality of pontoons connected to said plurality of supports, each of said plurality of pontoons adapted for ballast transfer, at least two hawsers connected to the MPU for connecting the MPU to an object at sea having a mooring system, a hawser guidance system to direct each of said hawsers to the object at sea;

b. a crane removably secured to said deck;

c. a multipurpose tower (MPT) removably secured to said deck wherein said MPT comprises a base structure mounted in said deck, a central tower mounted to said base structure, a top drive mounted to said central tower, a drawworks secured to said central tower; and a driller's cabin module mounted in said deck connected to said base structure, and d. an at least 6-point mooring system;

wherein the combination of said semisubmersible MPU, said at least two hawsers and said at least 6-point mooring system create a global equilibrium between the mooring system of an object at sea and the said at least 6-point mooring system.

2. The multipurpose unit of claim 1, wherein said semisubmersible MPU has a configuration that results in a combined environmental load of less than 1000 kips within a 100-year extreme weather condition.

3. The multipurpose unit of claim 1, wherein said semisubmersible MPU further has a lightship displacement of less than 15,000 short tons for use with the object at sea.

4. The multipurpose unit of claim 1, wherein the object at sea is a production platform for oil and natural gas wells.

5. The multipurpose unit of claim 1, wherein said crane is skiddable.

6. The multipurpose unit of claim 1, wherein said crane is modular.

7. The multipurpose unit of claim 1, wherein each of said at least two hawsers for connecting the MPU to the object at sea has a length which is selected from the group: length of the MPU, tendering distance, length of the object at sea, and combinations thereof.

8. The multipurpose unit of claim 7, wherein each of said at least two hawsers has an elasticity sufficient to accommodate the wave frequency between the object at sea and said MPU, and sufficient stiffness to synchronize the mean and low frequency movements between the object at sea and said MPU under an environmental load produced during a storm having a designation of up to a 10-year winter storm, when said MPU is in a tendering position.

9. The multipurpose unit of claim 8, wherein said hawsers remain slack during a storm designated as an at least a 10-year storm for the MPU, when said MPU is in a standby position.

10. The multipurpose unit of claim 1, wherein said at least 6-point mooring system comprises:

a. at least 6 anchors; and b. at least 6 mooring lines, each line consisting of: a first length of steel wire rope secured to each of the anchors, a length of polymer rope secured to each of said first length of steel wire rope, a second length of steel wire rope having a first and second end, wherein the first end is secured to said length of polymer rope and the second end is secured to said semisubmersible MPU, wherein each of said at leat 6 mooring lines has sufficient elasticity, stiffness and strength to accommodate the load on the semisubmersible MPU under an environmental load produced by and up to a 10-year storm in the semisubmersible tendering position, and further wherein each of said at least 6 mooring lines has a strength sufficient to withstand the environmental load produced by and up to a 100-year extreme weather condition when the semisubmersible MPU is moved to a 100-year extreme weather condition standby position.

11. The multipurpose unit of claim 1, further comprising a hawser winch for each of said at least two hawsers, wherein each of said at least two hawsers comprises a wire that winds on said hawser winch.

12. The multipurpose unit of claim 10, wherein each of said at least 6 mooring lines is tensioned.

13. The multipurpose unit of claim 1, wherein said plurality of pontoons are connected in a ring design having a moon pool.

14. The multipurpose unit of claim 13, adapted for use with a subsurface BOP and a low pressure drilling riser, further comprising a tensioning slip joint assembly disposed in said moon pool wherein said tensioning slip joint assembly comprises:

a. an inner barrel;

b. an outer barrel connected to said low pressure drilling riser for vertical movement control, said outer barrel overlapping said inner barrel;

c. a riser-tensioning cart disposed adjacent said moon pool;

d. a plurality of tensioning cylinders fixed to said outer barrel, and e. a gimbal system connected to said riser tensioning cart and said plurality of tensioning cylinders.

15. The multipurpose unit of claim 14, wherein said riser-tensioning cart is mounted on rails that slide adjacent said moon pool.

16. The multipurpose unit of claim 14, wherein said gimbal system comprises:

a. a gimbal base;

b. a first pin;

c. an arm;

d. a second pin; and e. a gimbal frame.

17. The multipurpose unit of claim 16, wherein said gimbal frame is triangular in shape.

18. The multipurpose unit of claim 13, for use with a surface BOP and a high pressure drilling riser, further comprising a tensioning slip joint assembly disposed in said moon pool wherein said tensioning slip joint assembly comprises:

a. an inner barrel;

b. a high pressure casing riser disposed within said inner barrel, collapsing said inner barrel;

c. an outer barrel connected to said high pressure casing riser for vertical movement control, said outer barrel overlapping said inner barrel;

d. a riser-tensioning cart disposed adjacent said moon pool;

e. a plurality of tensioning cylinders fixed to said outer barrel, and f. a gimbal system connected to said riser tensioning cart and said plurality of tensioning cylinders.

19. The multipurpose unit of claim 14, wherein said tensioning cylinder comprises between six and nine tensioning cylinders.

20. The multipurpose unit of claim 1, wherein the object at sea is selected from the group: a tension leg platform, a compliant tower, a jack-up platform, a deep draft caisson vessel, a floating drilling vessel, and a fixed leg production platform.

21. The multipurpose unit of claim 20, wherein when said object at sea is a tension leg platform comprising at least one tensioning line for securing to an additional anchor.

22. The multipurpose unit of claim 20, wherein when said object at sea is the compliant tower comprising at least one tensioning line for mooring a compliant tower to an additional anchor.

23. The multipurpose unit of claim 1, wherein said multipurpose tower is modular.

24. The multipurpose unit of claim 10, wherein said at least 6-point mooring system is an 8-point mooring system.

25. The multipurpose unit of claim 24, wherein said at least 6 anchors is at least 8 anchors and said at least 6 mooring lines is at least 8 mooring lines.

26. A mooring and tender system for securing a tender to a production platform comprising a semisubmersible tender comprising a deck, a plurality of supports having a rounded shape connected to said deck, a plurality of pontoons connected to said plurality of supports, each of said plurality of pontoons adapted for ballast transfer, at least two hawsers connected to said semisubmersible tender for connecting said semisubmersible tender to a production platform having a mooring system, a hawser guidance system to direct each of said at least two hawsers to the object at sea, a crane removably secured to the deck of said semisubmersible tender, a multipurpose tower removably secured to said deck, said multipurpose tower comprising a base structure mounted in said deck, a tower mounted to the base structure, a top drive mounted to the tower, a drawworks secured to the tower; and a driller's cabin module mounted in said deck connected to the base structure, and an at least 6-point mooring system for the semisubmersible tender which comprises:

a. at least 6 anchors, and b. at least 6 mooring lines, each mooring line consisting of: a first length of steel wire rope secured to each of the anchors, a length of rope secured to each of the first length of steel wire rope, a second length of steel wire rope having a first and second end, wherein the first end is secured to the length of rope and the second end is secured to said semisubmersible tender, wherein each of said at least 6 mooring lines has sufficient elasticity, stiffness and strength to accommodate load on the semisubmersible tender under an environmental load produced by and up to a 10-year storm in the semisubmersible tendering position, and further wherein each of said at least 6 mooring lines have a strength to withstand the environmental load produced by and up to a 100-year extreme weather condition when the semisubmersible tender is moved to a 100-year extreme weather condition standby position, and wherein said mooring system creates a global equilibrium between the mooring system of the production platform and said at least 6-point mooring system.

27. The mooring and semisubmersible tender system of claim 26, wherein said plurality of pontoons are connected in a ring configuration, wherein all of said plurality of pontoons have a shape selected from the group: rectangular, square and triangular.

28. The mooring and semisubmersible tender system of claim 26, wherein said at least 6-point mooring system comprises a 5-line mooring system and one broken mooring line.

29. The multipurpose unit of claim 26, wherein said at least 6-point mooring system is an 8-point mooring system.

30. The multipurpose unit of claim 29, wherein said at least 6 anchors is at least 8 anchors and said at least 6 mooring lines is at least 8 mooring lines.

31. The multipurpose unit of claim 30, wherein said at least 8-point mooring system comprises a 7-line mooring system and one broken mooring line.

32. The mooring and semisubmersible tender system of claim 26, wherein said ballast transfer is transversely at a rate in the range of between about 30 and about 300 gallons per minute.

33. The mooring and semisubmersible tender system of claim 26, wherein said ballast transfer is longitudinally at a rate in the range of between about 180 and about 300 gallons per minute.

34. The mooring and semisubmersible tender system of claim 26, wherein each of said plurality of pontoons has rounded edges.

35. The mooring and semisubmersible tender system of claim 26, wherein each of said plurality of the supports is in the form of a round column.

36. The mooring and semisubmersible tender system of claim 35, wherein said plurality of supports is between 3 and 12 round columns.

37. The mooring and semisubmersible tender system of claim 26, wherein each of said plurality of supports contain a member of the group comprising: ballast transfer equipment, bulk storage tanks, drilling mud storage tanks, fluid tanks, ballast control systems, mooring line storage reels, transfer equipment for fluids in the designated tanks and combinations thereof.

38. The mooring and semisubmersible tender system of claim 37, further comprising winches disposed within said plurality of supports, wherein said mooring line storage reels are connected to said winches, thereby lowering the center of gravity of the semisubmersible tender.

39. The mooring and semisubmersible tender system of claim 26, wherein said length of rope has an outer diameter of between about 4 and about 10 inches.

40. The mooring and semisubmersible tender system of claim 39, wherein said length of rope is a material selected from the group consisting of polyester, polypropylene, polyethylene, and combinations thereof.

41. The mooring and semisubmersible tender system of claim 39, wherein each of said at least two hawsers is made from a polyamide.

42. The mooring and semisubmersible tender system of claim 26, wherein said production platform is a member of the group: a deep draft caisson vessel (SPAR), a tension leg platform (TLP), a semisubmersible production vessel, a fixed leg production platform and a compliant tower production platform.

43. The mooring and semisubmersible tender system of claim 26, further comprising a measurement system to record the exact distance and spatial relationship between said semisubmersible tender and said production platform.

44. The mooring and semisubmersible tender system of claim 26, further comprising a camera system adapted to enable monitoring of said semisubmersible tender, said production platform, said at least two hawsers and said hawser guidance system.

45. The mooring and semisubmersible tender system of claim 26, further comprising a monitoring system to analyze any variation in tension of said at least two hawsers connecting said semisubmersible tender to said production platform.

46. The mooring and semisubmersible tendering system of claim 45, further comprising at least one mooring winch storage disposed in at least one of said plurality of supports in order to lower the center of gravity of the semisubmersible tender.

47. The mooring and semisubmersible tendering system of claim 37, wherein said fluid tanks contain sterile brine completion fluids.

48. A method for erecting a disassembled multipurpose tower from the deck of a multipurpose unit (MPU) and onto a production platform, wherein said MPU comprises a deck, a plurality of supports having a rounded shape connected to said deck, a plurality of pontoons connected to the supports, each pontoon being adapted for ballast transfer, at least two hawsers connected to the MPU for connecting the MPU to an object at sea having a mooring system, a hawser guidance system to direct each hawser to the object at sea; a crane having a slew ring, said crane removably secured to said deck, a multipurpose tower removably secured to the deck, wherein said multipurpose tower comprises a base structure mounted in the deck, a central tower mounted to the base structure, a top drive mounted to the central tower, a drawworks secured to the central tower, and a driller's cabin module mounted in the deck connected to the base structure, said method comprising the steps of:

a. mooring a multipurpose unit in proximity to a production platform, said production platform having a main deck, skid beams mounted on the main deck, and a preset mooring system;

b. connecting said platform to said multipurpose unit (MPU);

c. de-ballasting said platform to a first depth;

d. ballasting said MPU to the first draft such that the slew ring of said crane is approximately level with said main deck of said platform;

e. placing a skid frame on the skid beams on said platform using said crane;

f. placing a cellar module on the skid frame;

g. placing a BOP module on the cellar module;

h. placing a mud module on the cellar module;

i. placing a base frame on the mud module and the BOP module;

j. connecting said drawworks to the base frame;

k. placing said driller's cabin module on the mud module;

l. connecting a service porch to said driller's cabin module;

m. placing said multipurpose tower on the service porch and connecting it to said base frame;

n. erecting said multipurpose tower with said drawworks;

o. connecting setback drums to said multipurpose tower;

p. connecting a pipe racker to said multipurpose tower; and q. connecting an upending table to said driller cabin module.

49. A method for disassembling an erected multipurpose tower on a platform and removing and re-assembling the multipurpose tower on a multipurpose unit (MPU), wherein said MPU comprises a deck, a plurality of supports having a rounded shape connected to said deck, a plurality of pontoons connected to said supports, each pontoon being adapted for ballast transfer, at least two hawsers connected to said MPU for connecting said MPU to an object at sea having a mooring system, a hawser guidance system to direct each of said at least two hawsers to the object at sea; a crane removably secured to said deck of the MPU, a multipurpose tower removably secured to said deck, said multipurpose tower comprising a base structure having a base frame and mounted in said deck, a central tower mounted to the base structure, a top drive mounted to the central tower, a drawworks secured to the central tower, and a driller's cabin module mounted in said deck connected to the base structure, and wherein said platform comprises an upending table, at least one pipe racker, at least one setback drum, a mud module, a BOP module, a cellar module and a skid frame, said method comprising the steps of:

a. de-ballasting the platform to a first depth;

b. ballasting the MPU to a first draft wherein the slew ring of the crane is approximately level with the deck of the platform;

c. removing the upending table and placing it on said deck of said multipurpose unit (MPU);

d. removing the at least one pipe racker and placing it on said deck of said MPU;

e. removing the at least one setback drum and placing it on said deck of said MPU;

f. lowering said multipurpose tower using said drawworks onto the deck of said MPU;

g. disconnecting said multipurpose tower from the base frame;

h. picking up said multipurpose tower onto the deck of said MPU;

i. removing said drawworks onto the deck of said MPU;

j. removing the driller's cabin module onto the deck of said MPU;

k. removing the base frame onto the deck of the MPU;

l. connecting said drawworks to the base frame;

m. skidding the base frame over a moon pool;

n picking up a driller's control and connecting it to the base frame on the deck over the moon pool;

o. picking up said multipurpose tower and connecting said multipurpose tower to the base frame;

p. raising said multipurpose tower to a vertical position using said drawworks;

q. connecting a passive heave compensator to said multipurpose tower;

r. connecting the at least one setback drum to said multipurpose tower;

s. connecting the at least one pipe racker to said multipurpose tower;

t. connecting the upending table to the driller cabin module;

u. removing a mud module and placing it on said deck of said MPU;

v. removing a BOP module and placing it on said deck of said MPU;

w. removing a cellar module and placing it on said deck of said MPU, and x. removing a skid frame and placing it on said deck of said MPU.

50. A method for disassembling a multipurpose tower from a multipurpose unit (MPU) and erecting said multipurpose tower on a platform, wherein the MPU comprises a deck, a plurality of supports having a rounded shape connected to said deck, a plurality of pontoons connected to said plurality of supports, each pontoon being adapted for ballast transfer, at least two hawsers connected to said MPU for connecting said MPU to an object at sea having a mooring system, a hawser guidance system to direct each hawser to the object at sea; a crane removably secured to said deck of said MPU, a multipurpose tower removably secured to said deck, an upending table, at least one pipe racker, at least one setback drum, and a least one heave compensator, wherein said multipurpose tower comprises a base structure mounted having a base frame and in the deck, a central tower mounted to the base structure, a top drive mounted to the central tower, a drawworks secured to said multipurpose tower, and a driller's cabin module mounted in said deck connected to the base structure, said method comprising the steps of:

a. de-ballasting the platform to a first depth;

b. ballasting the MPU to a first draft wherein the slew ring of the crane is approximately level with the deck of the platform;

c. placing a skid frame on said platform;

d. placing a cellar module on said skid frame;

e. placing a BOP module on said cellar module;

f. placing a mud module on said cellar module;

g. removing the upending table and placing it on said deck of said MPU;

h. removing the at least one pipe racker and placing it on said deck of said MPU;

i. taking the at least one setback drum off said multipurpose tower and placing it on said deck of said MPU;

j. removing the heave compensator from said multipurpose tower and placing it on said deck of said MPU;

k. lowering said multipurpose tower with said drawworks and resting it on said deck of said MPU;

l. removing said multipurpose tower from the base frame and placing it on said deck of said MPU;

m. removing the driller's cabin module and placing it on said deck of said MPU;

n. skidding the base frame close to said crane and removing the drawworks module and placing it on said deck of said MPU;

o. placing the skid frame onto the mud module and the BOP module;

p. picking up the drawworks connection to the base frame;

q. moving the driller's cabin module from said deck and placing it on the mud module;

r. placing a service porch on said driller's cabin module and the mud module;

s. lifting the multipurpose tower from said MPU deck and connecting it to the base frame and laying it on the service porch;

t. using said drawworks to lift the tower to the vertical position;

u. hanging the at least on setback drum in said multipurpose tower;

v. hanging the at least one pipe racker on said multipurpose tower, and w. placing the upending table on the driller's cabin module.

51. A method for disassembling a multipurpose tower erected on a platform to the deck of a multipurpose unit (MPU), said MPU comprising a deck, a plurality of supports having a rounded shape connected to the deck, a plurality of pontoons connected to said plurality of supports, each pontoon being adapted for ballast transfer, at least two hawsers connected to said MPU for connecting said MPU to an object at sea having a mooring system, a hawser guidance system to direct each of said at least two hawsers to the object at sea; a crane removably secured to the deck of the MPU, a multipurpose tower removably secured to said deck, said multipurpose tower comprising a base structure having a base frame and mounted in the deck, a central tower mounted to the base structure, a top drive mounted to the tower, a drawworks secured to the multipurpose tower, and a driller's cabin module mounted in the deck connected to the base structure, and wherein said platform comprises a deck, an upending table, at least one pipe racker, at least one setback drum, a mud module, a BOP module, a cellar module, a service porch connected to the driller's cabin module, a skid frame, and skid beams said method comprising the steps of:

a. de-ballasting the platform to a first depth;

b. ballasting the MPU to a first draft wherein the slew ring of the crane is approximately level with the deck of the platform;

c. disconnecting the upending table from a driller's cabin module and placing it on the deck of the MPU;

d. disconnecting the at least one pipe racker from the tower and placing it on the deck of the MPU;

e. disconnecting the at least one setback drum from the tower and placing it on the deck of the MPU;

f. lowering the multipurpose tower with the drawworks to a service porch;

g. disconnecting the multipurpose tower from the base frame and placing it on the deck of the MPU;

h. disconnecting the service porch from the driller's cabin module and placing it on the deck of the MPU;

i. removing the driller's cabin module from a mud module and placing it on the deck of the MPU;

j. disconnecting the drawworks from the base frame and placing it on the deck of the MPU;

k. removing the base frame from the mud module and BOP module and placing it on the deck of the MPU;

l. removing the mud module from a cellar module and placing it on the deck of the MPU;

m. removing the BOP module from the cellar module and placing it on the deck of the MPU;

n. removing the cellar module from a skid frame and placing it on the deck of the MPU, and o. removing the skid frame from the skid beams using said crane.

52. A method for handling tubulars on a multipurpose unit (MPU), said MPU comprising a deck, a plurality of supports having a rounded shape connected to the deck, a plurality of pontoons connected to said plurality of supports, each pontoon being adapted for ballast transfer, at least two hawsers connected to said MPU for connecting said MPU to an object at sea having a mooring system, a hawser guidance system to direct each of said at least two hawsers to the object at sea; a crane removably secured to the deck of the MPU, an upending table, a pipe racker, a multipurpose tower removably secured to a deck, said multipurpose tower comprising a base structure mounted in the deck, a central tower mounted to the base structure, a top drive mounted to the tower, a drawworks secured to the multipurpose tower, and a driller's cabin module mounted in the deck connected to the base structure, said method comprising the steps of:

a. making a stand of tubulars;

b. disposing the stands of tubulars in a container on the deck of the MPU;

c. lifting the container from the MPU deck and placing the container on the upending table;

d. lifting the container with the upending table to a vertical position;

e. latching the container in the vertical position to the multipurpose tower, and f. pulling tubulars from the container with the pipe racker for use.

53. A multipurpose tower (MPT) for use on a multipurpose unit (MPU) deck, said MPU comprising a deck, a plurality of supports having a rounded shape connected to the deck, a plurality of pontoons connected to said plurality of supports, each pontoon being adapted for ballast transfer; at least two hawsers connected to the MPU for connecting the MPU to an object at sea having a mooring system, a hawser guidance system to direct each of said at least two hawsers to the object at sea, a crane removably secured to the deck of the MPU, a multipurpose tower (MPT) removably secured to the deck, said MPT comprises a base structure, a central tower mounted on the base structure, a top drive mounted on the tower, a drawworks mounted on the tower, a driller's cabin mounted on the tower, at least one pipe racker connected to the tower, at least one set back drum connected to the tower, and rails on which to rest the top drive.

54. The multipurpose tower of claim 53, further comprising an upending table on the base structure for attaching a first tubular container to the tower in a vertical position.

55. The multipurpose tower of claim 54, further comprising a skid frame on which is mounted a cellar deck module and a BOP module and a mud module located on the BOP module.

56. The multipurpose tower of claim 53, further comprising a service trolley hoisted with the top drive for maintenance of the multipurpose tower.

57. The multipurpose tower of claim 53, further comprising a service crane disposed on said tower.

58. The multipurpose tower of claim 53, further comprising a traveling block disposed on the rails and engaging the top drive.

59. The multipurpose tower of claim 53, further comprising a service porch for holding and supporting umbilicals and operationally supporting the tower.

60. The multipurpose tower of claim 59, wherein the service porch is a catwalk.

61. The multipurpose tower of claim 60, wherein the catwalk comprises piping through which electric lines, fluid lines and other material can be passed and operationally support the tower.

62. The multipurpose tower of claim 59, wherein said service porch comprises a container skidding system for receiving second tubular containers and supporting them on the service porch and skidding them to the upending table.

63. The multipurpose tower of claim 53, further comprising a rotary work table attached in the base structure.

64. The multipurpose tower of claim 63, further comprising an iron roughneck and wherein said rotary worktable can orient the iron roughneck to a first and second position, and wherein one position permits the tubulars to be lifted to a vertical position from the catwalk using a drawworks.

65. The multipurpose tower of claim 64, wherein the first position is 90 degrees from the second position.

66. The multipurpose tower of claim 63, further comprising at least one removable snubbing post secured on the base structure.

67. The multipurpose tower of claim 53, wherein said MPT is countersunk into the MPU.

68. The multipurpose tower of claim 53, wherein said MPT is skiddable from the middle of the MPU to the side of the MPU.

69. The multipurpose tower of claim 53, wherein the MPT can be mounted on a skid frame either parallel to or perpendicular to the plane of movement of the skid frame.

70. A method of using a multipurpose unit (MPU) for the purpose of coil tubing intervention wherein the MPU is associated with a subsea well in which is installed a Christmas tree having a corrosion cap, a blow-out preventor (BOP), a master valve, and a subsurface safety control valve, and wherein said MPU comprises a deck, a configuration that results in a combined environmental load less than 1000 kips in a 100-year extreme weather condition, a plurality of supports having a rounded shape and connected to said deck, a plurality of pontoons connecting said plurality of supports, each of said plurality of pontoons being adapted for ballast transfer, and an at least 8-point tender mooring system, said method of coil tubing intervention comprising the steps of:

a. closing said subsurface safety control valve;

b. closing said master valve on the tree;

c. deploying a remotely operated vehicle (ROV) to inspect the tree, pull the tree corrosion cap and inspect the BOP (blow-out protector) connector;

d. running a subsea BOP stack and a high-pressure well intervention riser;

e. latching said BOP on the tree and nippling up the coil tubing injector head, BOP and high-pressure lubricator;

f. opening said master valve and said subsurface safety control valve and recording the stabilized pressure at the surface;

g. running coil tubing in the well hole to a specified depth;

h. displacing said coil tubing with inert gas to another specified depth and recording the stabilized pressure at the surface;

i. repeating the foregoing procedural steps at successively deeper depths until a target surface pressure is recorded;

j. pulling out of the well hole with coil tubing;

k. closing said subsurface safety control valve and said master valve;

l. pulling the BOP and riser;

m. setting the corrosion cap with the ROV and a subsea tugger;

n. opening said subsurface safety control valve and said master valve, and o. resuming production.

71. A method of using a semi-submersible multipurpose unit (MPU) for the purpose of the removal of a subsea Christmas tree, wherein the MPU comprises a deck, a configuration that results in a combined environmental load less than 1000 kips in a 100-year extreme weather condition, a plurality of supports having a rounded shape and connected to said deck, a plurality of pontoons connecting said plurality of supports, each of said plurality of pontoons being adapted for ballast transfer, an at least 8-point mooring system, wherein said Christmas tree comprises a corrosion cap, a BOP, a master valve and a subsurface safety control valve, said method of removal of a subsea Christmas tree comprising the steps of:

a. closing the subsurface safety control valve;

b. closing the master valve on the tree;

c. deploying a remotely operated vehicle (ROV), inspecting the tree, pulling the tree corrosion cap and inspecting the BOP connector;

d. running a subsea BOP stack and a high-pressure well intervention riser;

e. latching the BOP on the tree and nippling up surface well intervention BOP;

f. opening the master valve on the tree while rigging up wire line;

g. running in the well hole with tubing plug on wire line and setting in a hanger profile;

h. disconnecting the tree, pulling the tree to the surface and setting back for refurbishment;

i picking up a new tree and running it to the sea floor;

j. connecting the new tree to the wellhead, function and pressure testing the new tree;

k. running in the well hole with wire line and retrieving tubing plugs;

l. pulling the BOP and riser;

m. setting the corrosion cap with ROV and subsea tugger;

n. opening the subsurface safety control valve and master valve, and o. resuming production.

72. A method of using a semi-submersible multipurpose unit (MPU) having a modular tower installed thereon, for the purpose of conducting a subsea well intervention operation in a subsea well on which there is installed a corrosion cap, said MPU comprising a deck, a configuration that results in a combined environmental load less than 1000 kips in a 100-year extreme weather condition, a plurality of supports each having a rounded shape and connected to said deck, a plurality of pontoons connecting said plurality of supports, each of said plurality of pontoons being adapted for ballast transfer, an at least 8-point mooring system, said method comprising the steps of:

a) moving the tender and rig over the well;

b) picking up the work string and tripping it into the well hole;

c) pulling out the corrosion cap, preferably assisted by an ROV;

d) tripping in the well hole with a wash tool, cleaning and inspecting the wellhead;

e) rigging up the riser running tools and moving an subsea completion BOP with a subsea wellhead adapter under the tower;

f) running a BOP using a high-pressure riser with a ball joint, stress joint, and tensioner slip joint;

g) landing the BOP on the well;

h) securing the surface systems and testing the BOP;

i) picking up the completion work string;

j) isolating the well preparatory fluid system from the sterile completion fluid system;

k) tripping in the hole to clean out the casing to the bottom;

l) circulating the well hole and tripping out of the hole;

m) rigging up a wire line and running cement bond logs;

n) running a casing scraper, using a bristle brush and displacing the hole with sterile completion fluid;

o) rigging up the wire line, making a gamma ray trip and setting up a sump packer;

p) testing the BOP;

q) tripping in the hole with tubing conveyed perforating guns, perforating, flowing back and tripping out of the hole;

r) tripping in the hole with gravel pack assembly and fracturing the gravel pack;

s) tripping out of the hole, laying down a work string and gravel packing tools;

t) picking up and running chrome tubing and flat packs;

u) setting a tubing hanger and tubing plugs in the well bore;

v) pulling a high-pressure riser and an BOP;

w) moving a subsea completion tree under the tower;

x) running the subsea completion tree with a high-pressure riser;

y) installing tree control lines, function testing the tree and closing the lower subsurface control valve;

z) installing and pulling in flex flow lines and control umbilicals;

aa) pulling plugs from the tubing hanger;

bb) running in the hole with coil tubing and displacing tubing down to lower a subsurface control valve;

cc) pulling the coil tubing, and closing the tree master valve;

dd) pulling the high-pressure riser;

ee) installing a completion tree corrosion cap and filling with corrosion fluid; and installing a debris cap.

73. A method for drilling and completing a well from a deep draft caisson vessel (DDC), wherein the multipurpose unit (MPU) is tendered to the DCC in a tender assist mode, said said MPU comprising a deck, a configuration that results in a combined environmental load less than 1000 kips in a 100-year extreme weather condition, a plurality of supports each having a rounded shape and connected to said deck, a plurality of pontoons connecting said plurality of supports, each of said plurality of pontoons being adapted for ballast transfer, an at least 6-point mooring system, said method comprising the following steps:

a) set skid drilling equipment over a center well slot located on the DDC, while removing the corrosion cap from a subsea wellhead;

b) move the DDC over the subsea wellhead using the DDC's mooring system;

c) lower a drilling riser, which has been parked over the center well slot, and connect the drilling riser to the subsea wellhead;

d) nipple up the surface BOP on the drilling riser;

e) run in the hole with drilling assembly, drill out a casing, and displace to weighted drilling fluid while drilling the casing shoe;

f) drill a hole to casing point and pick up drill out of the hole;

g) run a casing and a casing hanger in wellhead and cement;

h) run in hole with a drilling assembly, drill to casing point, and pick up drill out of the hole;

i) run wire line logs;

j) run a casing and land casing hanger in wellhead and cement;

k) displace cement with seawater and check to ensure casing cement float equipment is working properly;

l) run in hole with a test packer and set below subsea wellhead;

m) pressure test casing, disconnect from test packer, and pick up drill out of the hole in the completion work string;

n) nipple down surface BOP and set back on BOP test stump;

o) disconnect drilling riser from subsea wellhead and set in its park position;

p) skid drilling equipment set to the well's designated production slot;

q) trip in hole with wash tool and clean and inspect wellhead;

r) rig-up casing running tools;

s) run a riser with stress joint and keel joint;

t) lock a tieback connector and test;

u) rig-down riser running tools and offload;

v) install a tubing plug;

w) nipple up BOPs and test and set wear bushing;

x) rig-up a wire line, run base line metal thickness, and log across stress & keel joints;

y) pick up a completion work string and trip in hole to clean out casing to bottom and circulate hole with saltwater;

z) rig up and run wire line logs;

aa) run a casing scraper/bristle brush and displace hole with completion fluid;

bb) rig up wire line logs and set a sump packer;

cc) test BOPs;

dd) trip in hole with perforating guns, perf, flow back, and trip out of hole;

ee) trip in hole with a gravel pack assembly and a gravel pack;

ff) trip out of hole and lay down a completion work string and gravel pack tools;

gg) pick up and run a chrome tubing, a dual string, and flat packs;

hh) set tubing hanger plugs;

ii) nipple down BOPs, nipple up tree, flex flowlines and umbilicals;

jj) pull plugs, set dual packer, and displace riser with nitrogen, and kk) remove tubing plug and flow back well to platform in order to unload well.

* * * * *